US012372080B2

(12) United States Patent
McNichol et al.

(10) Patent No.: US 12,372,080 B2
(45) Date of Patent: Jul. 29, 2025

(54) HYDRAULIC PUMPING SYSTEM

(71) Applicant: Richard Frederick McNichol, Surrey (CA)

(72) Inventors: Richard Frederick McNichol, Surrey (CA); Alexandre Eroujenets, Pitt Meadows (CA)

(73) Assignee: Richard Frederick McNichol, Surrey (CA)

( * ) Notice: Subject to any disclaimer, the term of this patent is extended or adjusted under 35 U.S.C. 154(b) by 0 days.

(21) Appl. No.: 18/122,629

(22) Filed: Mar. 16, 2023

(65) Prior Publication Data

US 2024/0044326 A1 Feb. 8, 2024

Related U.S. Application Data

(63) Continuation of application No. 16/631,152, filed as application No. PCT/US2018/042750 on Jul. 18, 2018, now Pat. No. 11,608,824.

(60) Provisional application No. 62/571,722, filed on Oct. 12, 2017, provisional application No. 62/534,143, filed on Jul. 18, 2017.

(51) Int. Cl.

| | |
|---|---|
| ***F04B 47/14*** | (2006.01) |
| ***E21B 43/12*** | (2006.01) |
| ***F04B 9/105*** | (2006.01) |
| ***F04B 19/00*** | (2006.01) |
| ***F04B 47/04*** | (2006.01) |
| ***F04B 53/10*** | (2006.01) |
| ***F04B 53/14*** | (2006.01) |

(52) U.S. Cl.

CPC ..... *F04B 47/145* (2013.01); *F04B 47/04* (2013.01); *E21B 43/129* (2013.01); *F04B 9/1056* (2013.01); *F04B 19/003* (2013.01); *F04B 53/1005* (2013.01); *F04B 53/1007* (2013.01); *F04B 53/144* (2013.01)

(58) Field of Classification Search

CPC ..... F04B 47/145; F04B 47/04; F04B 47/14; F04B 9/08; F04B 9/10; F04B 9/1053; F04B 9/1056; F04B 19/003; F04B 53/10; F04B 53/1002; F04B 53/1005; F04B 53/1007; F04B 53/144; E21B 43/121; E21B 43/129; E21B 43/13

See application file for complete search history.

(56) References Cited

U.S. PATENT DOCUMENTS

| | | | | |
|---|---|---|---|---|
| 2,726,605 A | | 12/1955 | Tebbetts | |
| 2,837,029 A | * | 6/1958 | Mohnkern | F04B 47/08 92/110 |
| 3,374,746 A | * | 3/1968 | Chenault | F04B 9/10 417/403 |

(Continued)

OTHER PUBLICATIONS

International Search Report and Written Opinion issued in PCT/US2018/042750, dated Oct. 1, 2018.

*Primary Examiner* — David N Brandt

(74) *Attorney, Agent, or Firm* — Knobbe Martens Olson & Bear, LLP

(57) ABSTRACT

Pumps are provided, more particularly piston type pumps having increased energy efficiency, systems incorporating such piston type pumps, and methods of operating piston type pumps. The pumps are suitable for pumping of oil from an oil well or for pumping other liquids such as ground water, subterranean liquids, brackish water, sea water, waste water, cooling water, gas, coolants, and the like.

10 Claims, 10 Drawing Sheets

(56) References Cited

U.S. PATENT DOCUMENTS

| | | | | |
|---|---|---|---|---|
| 4,219,311 | A | 8/1980 | Simon | |
| 4,470,775 | A | 9/1984 | Lonardo | |
| 4,880,363 | A | 11/1989 | Holland | |
| 5,797,452 | A | 8/1998 | Martin | |
| 2005/0169776 | A1 | 8/2005 | McNichol | |
| 2005/0249613 | A1* | 11/2005 | Jordan | F04B 47/08<br>417/390 |

* cited by examiner

HYDRAULIC PUMPING SYSTEM

INCORPORATION BY REFERENCE TO RELATED APPLICATIONS

Any and all priority claims identified in the Application Data Sheet, or any correction thereto, are hereby incorporated by reference under 37 CFR 1.57. This application is a continuation of U.S. patent application Ser. No. 16/631,152, filed Jan. 14, 2020, which is the national phase under 35 U.S.C. § 371 of prior PCT International Application No. PCT/US2018/042750, filed on Jul. 18, 2018, which claims the benefit of U.S. Provisional Patent Application No. 62/571,722, filed on Oct. 12, 2017, and U.S. Provisional Patent Application No. 62/534,143, filed on Jul. 18, 2017. Each of the above-referenced applications is hereby incorporated by reference in its entirety and is hereby made a portion of this application.

FIELD

The present application relates generally to pumps, and more particularly to piston type pumps having increased energy efficiency, systems incorporating such piston type pumps, and methods of operating piston type pumps.

BACKGROUND

It has been estimated that approximately 85% of the total cost of operating a conventional pump is attributable to energy consumption. Pumping systems account for nearly 20% of the world's electrical energy demand and range from 25% to 50% of the energy required by industrial plant operations.

Similarly, maintenance costs account for approximately 10% of the total cost of operating a conventional pump.

Pumping liquids against substantial hydraulic heads is a problem encountered in pumping out mines, deep wells, and similar applications such as pumping water back up, over a hydro dam during low energy usage periods, for subsequent recovery during high energy usage periods, and for run-of-the-river hydro power applications utilizing the potential energy of water in a standing column.

Attempts have been made to provide devices which utilize a piston type pump where energy is recovered from a column of liquid acting downwardly on the piston, as the piston moves downwardly, to assist in subsequently raising the piston with a volume of liquid to be pumped upwardly.

SUMMARY

An improved pumping apparatus is provided capable of pumping liquids against significant hydraulic heads, such as encountered in deep wells or in pumping out mines, without requiring pumps with high output heads.

Also provided is an improved piston type pumping apparatus with provision for energy recovery or energy conservation, having significantly improved efficiency compared with prior art devices.

Further provided is an improved piston type pumping apparatus which is simple and rugged in construction, and efficient to operate and install.

In certain embodiments, a pumping apparatus for a well is provided. The well includes a power fluid passage in fluid communication with a power fluid line, a product fluid passage in fluid communication with a product fluid line, a piston reciprocatingly mounted within the pumping apparatus, the piston defining a product fluid chamber in fluid communication with the product fluid passage and comprising a first check valve, a bottom block positioned at a bottom portion of the pumping apparatus, the bottom block comprising a well fluid inlet having a second check valve, a well fluid intake chamber positioned between the bottom block and the piston and configured to receive well fluid through the second check valve when the second check valve is open, and one or more piston vent chambers, each piston vent chamber in fluid communication with the product fluid chamber via one or more vents. The product fluid chamber is configured to receive well fluid from the well fluid intake chamber through the first check valve when the first check valve is open.

In certain embodiments, a pumping apparatus for a well is provided. The pumping apparatus includes a power fluid passage in fluid communication with a power fluid line, a counterbalance fluid passage in fluid communication with a counterbalance fluid line, a piston reciprocatingly mounted within the pumping apparatus, the piston defining a counterbalance fluid chamber in fluid communication with the counterbalance fluid passage, a first check valve, a well fluid intake chamber in fluid communication with well fluid external to the pumping apparatus via one or more vents and in fluid communication with the first check valve, a bottom block positioned at a bottom portion of the pumping apparatus, the bottom block comprising a well fluid outlet having a second check valve configured to allow well fluid to flow out of the pumping apparatus when the second check valve is open, a well fluid outflow chamber positioned between the well fluid intake chamber and the bottom block, the well fluid outflow chamber configured to receive well fluid through the first check valve when the first check valve is open, and one or more piston vent chambers, each piston vent chamber in fluid communication with the counterbalance fluid chamber via one or more vents.

BRIEF DESCRIPTION OF THE DRAWINGS

Features of the present disclosure will become more fully apparent from the following description and appended claims, taken in conjunction with the accompanying drawings. It will be understood these drawings depict only certain embodiments in accordance with the disclosure and, therefore, are not to be considered limiting of its scope; the disclosure will be described with additional specificity and detail through use of the accompanying drawings. An apparatus, system or method according to some of the described embodiments can have several aspects, no single one of which necessarily is solely responsible for the desirable attributes of the apparatus, system or method. After considering this discussion, and particularly after reading the section entitled "Detailed Description of the Preferred Embodiment" one will understand how illustrated features serve to explain certain principles of the present disclosure.

DETAILED DESCRIPTION

Figure 1:
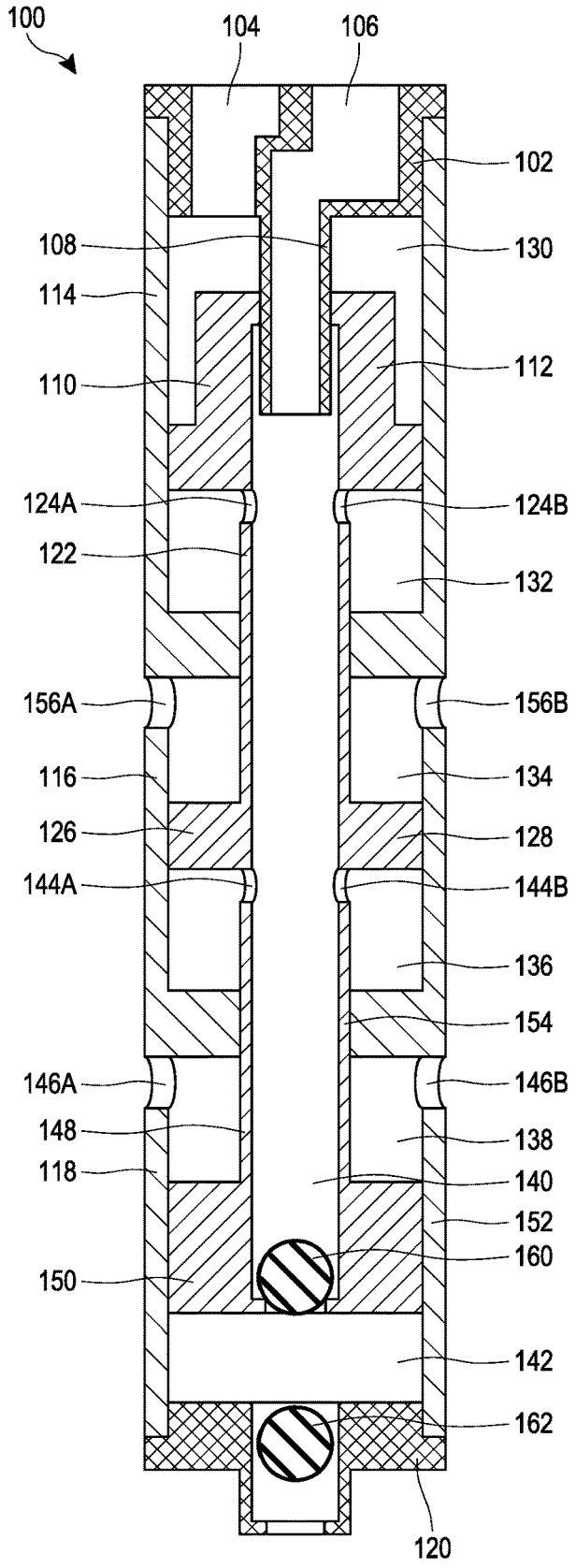
FIG. 1 provides a cross-sectional view of a first embodiment of a high production discharge pump for a well.

In the following detailed description, only certain exemplary embodiments have been shown and described, simply by way of illustration. As those skilled in the art would realize, the described embodiments may be modified in various different ways, all without departing from the spirit or scope of the present disclosure. Accordingly, the drawings and description are to be regarded as illustrative in nature and not restrictive. In addition, when an element is referred to as being "on" another element, it can be directly on the another element or be indirectly on the another element with one or more intervening elements interposed there between. Also, when an element is referred to as being "connected to" another element, it can be directly connected to the another element or be indirectly connected to the another element with one or more intervening elements interposed there between. Hereinafter, embodiments of the disclosure will be described with reference to the attached drawings. If there is no particular definition or mention, terms that indicate directions used to describe the disclosure are based on the state shown in the drawings. Further, the same reference numerals indicate the same members in the embodiments.

FIG. 1 illustrates an embodiment of a pumping apparatus 100 of an embodiment. The pump 100 includes a top block 102 with a power fluid passage 104 allowing fluid communication with a power fluid line (not shown) and a product fluid passage 106 allowing fluid communication with a product fluid line (not shown), as well as a hub 108 extending into a piston block 110 of a top piston 112. The top block 102 is seated in a top cylinder 114, which is adjacent to a recovery cylinder 116 and a pump cylinder 118. A bottom block 120 is set in the pump cylinder 118. The top cylinder 114 houses the piston block 110 of the top piston 112, which is supported by a piston rod 122 having vents 124A-B to a piston vent chamber 132.

The chamber 132 is encompassed by the top cylinder 114, the piston rod 122, and the piston block 110. Surfaces of the top piston 112, the top block 102, and hub 108 enclose a power fluid chamber 130. The recovery cylinder 116 includes recovery cylinder vents 156A-B. A piston block 126 of a recovery piston 128, the top cylinder 114, and the recovery cylinder 116 encompass a well vent chamber 134. A piston rod 148 housed in the recovery cylinder 116 includes piston rod vents 144A-B to a piston vent chamber 136. The chamber 136 is encompassed by the recovery piston block 126, the piston rod 148, and the recovery cylinder 116. The pump cylinder 118 includes pump cylinder vents 146A-B. The piston rod 148 in the pump cylinder 118, the recovery cylinder 116, and a bottom piston block 150 of a bottom piston 152 encompass a well vent chamber 138. The interior of the piston rods and the interior of the passage 106 of the hub 108 encompass a product fluid chamber 140.

The top piston 112, recovery piston 128, and bottom piston 152 collectively form a piston 103. In certain embodiments, the top piston 112, the recovery piston 128, and the bottom piston 152 may be sections forming a single piston 103 of the pump 100. In other embodiments, the top piston 112, the recovery piston 128, and the bottom piston 152 of the piston 103 may be separate piston components.

The top cylinder 114, the recovery cylinder 116, and the pump cylinder 118 collectively form a cylinder 101. In certain embodiments, the top cylinder 114, the recovery cylinder 116, and the pump cylinder 118 may be sections forming a single cylinder 101 of the pump 100. In other embodiments, the top cylinder 114, the recovery cylinder 116, and the pump cylinder 118 of the cylinder 101 may be separate cylinder components.

At the bottom of chamber 140, a transfer check valve 160 is provided. The bottom of the transfer check valve 160, the bottom piston block 150 and the bottom block 120 encompass a well fluid intake chamber 142. The bottom block 120 is provided with an intake check valve 162. The transfer check valve 160 and intake check valve 162 are one-way valves, allowing fluid to flow through the intake check valve 162 into chamber 142 inside the pump 100, but not in the reverse direction. The transfer check valve 160 and intake check valve 162 can be self-actuating valves, such that they require no electronic or manual control, but rather open and close solely by the force of the fluid moving therethrough and/or by pressure changes in chamber 142. In such embodiments, any suitable type of one-way valve can be utilized, including check valves and the like.

Check valves are valves that permit fluid to flow in only one direction. In certain embodiments, as shown in FIG. 1, one or both of the transfer check valve 160 and the intake check valve 162 can be ball check valves. Ball check valves contain a ball that sits freely above a seat, which has only one opening therethrough. The ball has a diameter that is larger than the diameter of the opening. When the pressure behind the seat exceeds the pressure above the ball, liquid is allowed to flow through the valve; however, once the pressure above the ball exceeds the pressure below the seat, the ball returns to rest in the seat, forming a seal that prevents backflow. The ball can also be connected to a spring or other alignment device. Such alignment devices are useful if the pump operates in a non-vertical orientation. In some embodiments, the ball can be replaced by another shape, such as a cone.

Swing check valves can also be utilized. Swing check valves use a hinged disc that swings open with the flow. Any other suitable type of check valve, including dual flap check valves and lift check valves, can also be utilized. Numerous other types of valves can be utilized, including reed valves, diaphragm valves. The valves can optionally be electronically controlled. Using standard computer process control techniques, such as those known in the art, the opening and closing of each valve can be automated. In such embodiments, two-way valves can advantageously be utilized.

While FIG. 1 depicts one intake and one transfer check valve, any suitable number of valves can be employed, for example, 1, 2, 3, 4, 5, or more intake check valve, and 1, 2, 3, 4, 5, or more transfer check valve.

The pump 100 can be of any suitable size. The preferred size can be selected based upon various factors such as the amount of liquid to be pumped, the type of liquid, and other factors. For example, the pump cylinder 118 can have a diameter of 1, 3, 6, 12, 24, or 36 inches or more.

As described above, the pump 100 includes a piston 103 having piston block portions (top piston 112, recovery piston 128, bottom piston 150) and rod portions including vents (piston rod vents 124A-B into chamber 132 and piston rod vents 144A-B into chamber 136). The piston 103 includes the center chamber (chamber 140) and the transfer check valve 160. Preferably, the transfer check valve 160 is a one-way valve, allowing fluid to flow from chamber 142 into chamber 140, but not in the reverse direction. In certain embodiments, the piston 103 is reciprocatingly mounted in the pump 100.

The pump 100 can operate at any angle, including vertical, horizontal, or any angle there between. The passage 104 comprises an inlet to the power fluid line such that power fluid can be provided to and/or removed from the pump 100 through the top block 102. FIG. 2A illustrates the flow of power fluid, as well as the flow of well fluid, on a power (down) stroke. As described in further detail herein, an arrow 170 indicates the direction of flow of power fluid during a power (down) stroke. Arrows 172A-D, 174A-B, 178A-B, and 182A-C indicate the direction of flow of product fluid within the pump 100 during a power (down) stroke. Arrows 176A-B and 180A-B indicate the direction of flow of well fluid within the pump 100 during the power (down) stroke.

Figure 2B:
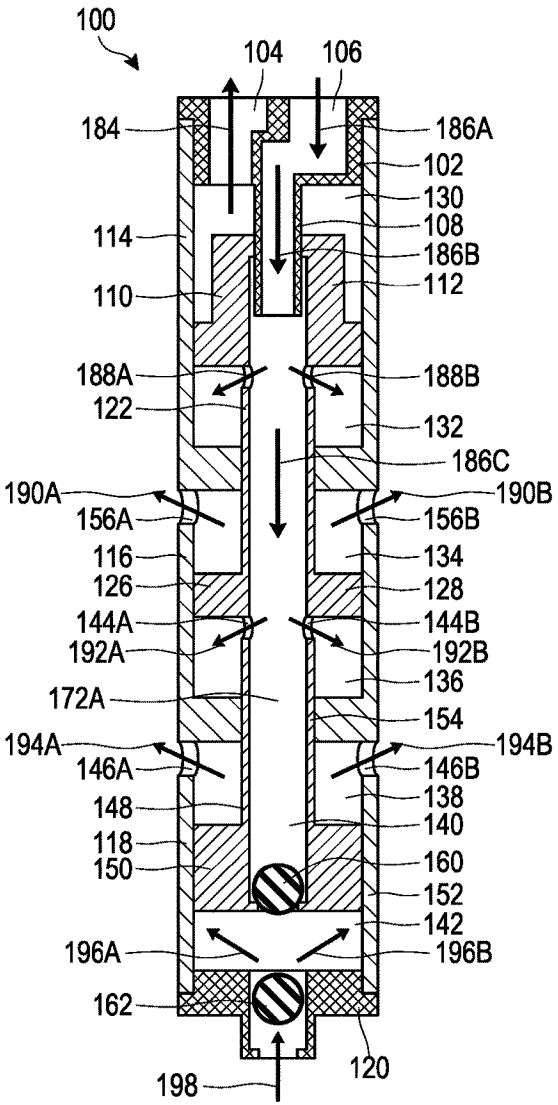
FIGS. 2A-B provide cross-sectional views of the pump of FIG. 1 showing flow of power fluid and well fluid on the power (down) stroke and on the recovery (up) stroke.
Figure 2A:
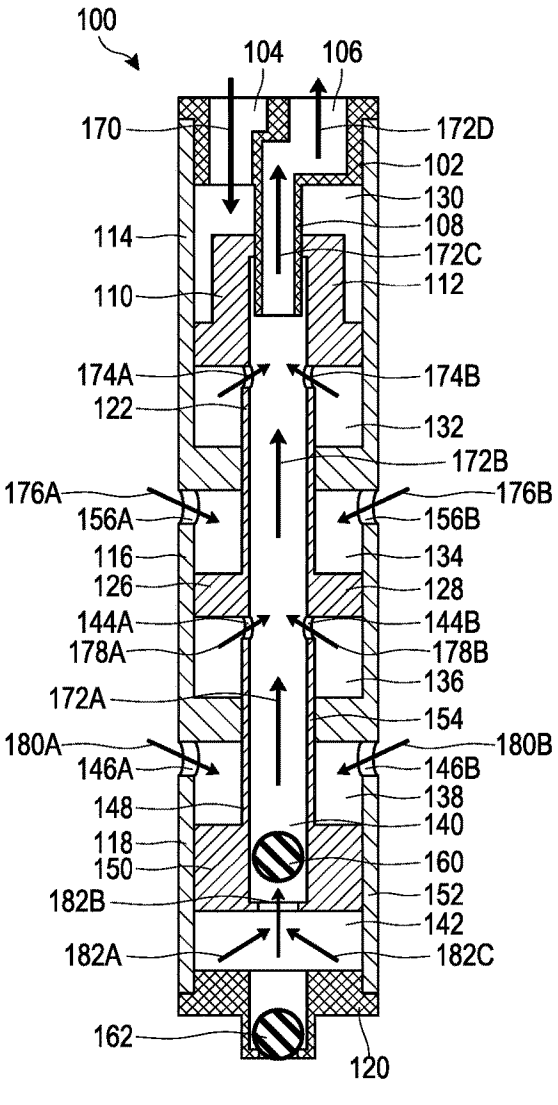

FIG. 2B illustrates the flow of power fluid, as well as the flow of well fluid, on a recovery (up) stroke. As described in further detail herein, an arrow 184 indicates the direction of flow of power fluid during the recovery (up) stroke. Arrows 186A-C, 188A-B, and 192A-B indicate the direction of the flow of product fluid during the recovery (up) stroke. Arrows 190A-B, 194A-B, 196A-B, and 198 indicate the direction of the flow of well fluid during the recovery (up) stroke.

Figure 3B:
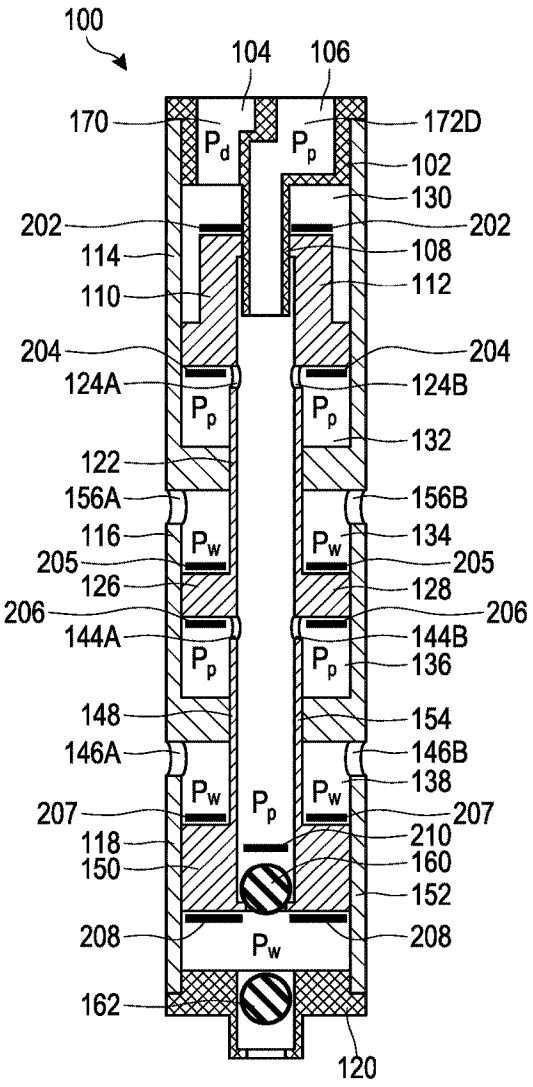
FIGS. 3A-B provide cross-sectional views of the pump of FIG. 1, showing surface areas of the pump on the power (down) stroke and on the recovery (up) stroke.
Figure 3A:
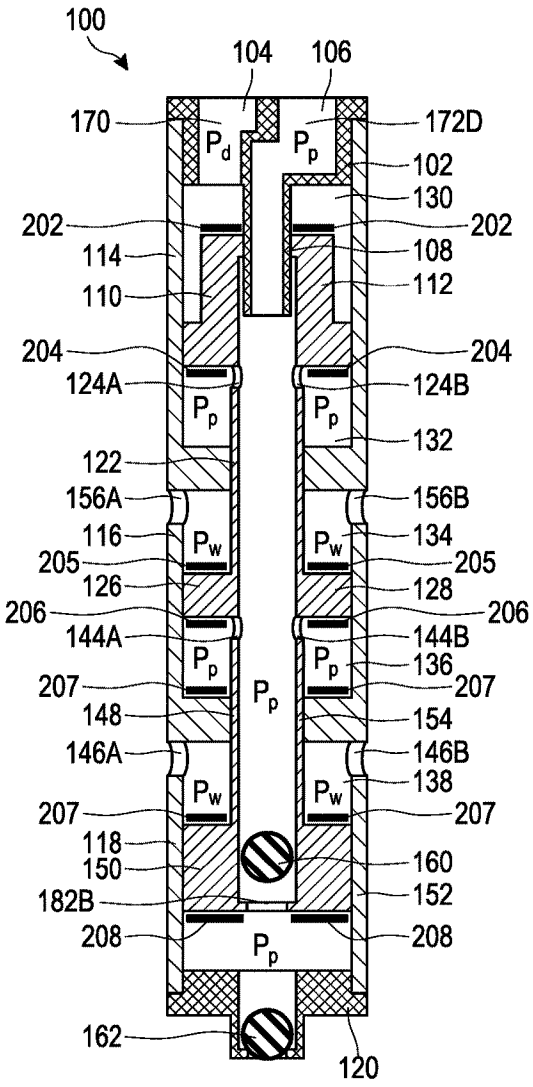

FIG. 3A illustrates surfaces within the pump 100 on which the power fluid and well fluid act during the power (down) stroke. FIG. 3B illustrates surfaces within the pump 100 on which the power fluid and well fluid act during the recovery (up) stroke. In the embodiment illustrated in FIG. 1, the power fluid chamber (chamber 130) is defined by surfaces of the hub 108, the top piston 112, and the interior surface of the top cylinder 114. The surface area upon which the power fluid acts is identified in FIG. 3A as area 202, while the surface areas upon which the product fluid on the power (down) stroke acts are identified as areas 204, 206 and 208, and the surface areas upon which the well fluid act on the power (down) stroke are identified as areas 205 and 207. The surfaces of the piston experience pressure due to forces exerted by the drive site, the pressure site, and the well. Pressure from the drive site, product site, and well pressure, identified respectively, as Pd, Pp, and Pw, are shown schematically in FIGS. 3A-B. The surface areas upon which the well fluid acts on the recovery (up) stroke are identified as areas 205, 207, and 208 in FIG. 3B. The surface area upon which the power fluid acts is identifies as area 202 in FIG. 3B. The surface areas upon which the product fluid acts on the recovery (up) stroke are identified as areas 204, 206, and 210.

Figure 4B:
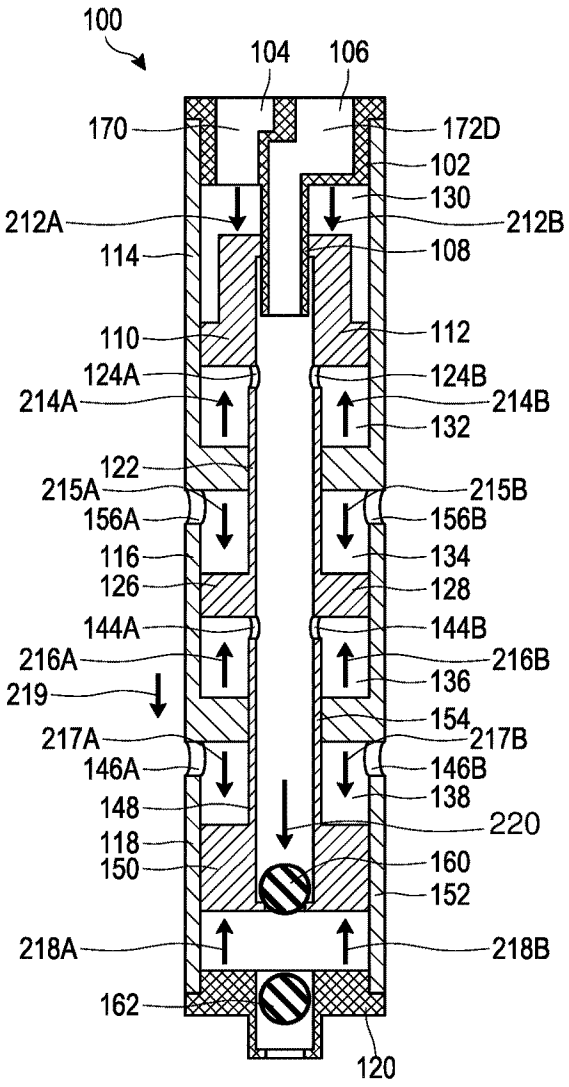
FIGS. 4A-B provide cross-sectional views of the pump of FIG. 1, showing forces applied to the piston on the power (down) stroke and on the recovery (up) stroke.
Figure 4A:
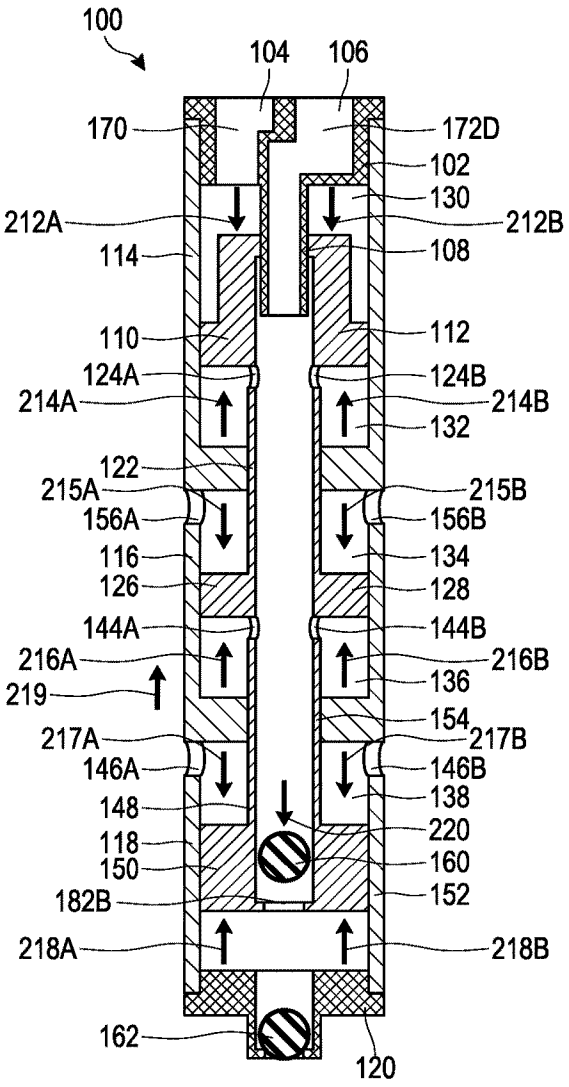

FIG. 4A schematically illustrates the corresponding forces generated by the flow of power fluid, product fluid, and well fluid on the power (down) stroke. Arrows 212A and 212B schematically illustrate a force ($F_1$) generated by the flow of power fluid on the power (down) stroke and acting on the surface area 202. Arrows 214A and 214B schematically illustrate a force ($F_2$) generated by the product fluid on the power (down) stroke and acting on the surface area 204. Arrows 216A and 216B schematically illustrate a force ($F_3$) generated by the product fluid on the power (down) stroke and acting on the surface area 206. Arrows 218A-B schematically illustrate a force ($F_4$) generated by the product fluid on the power (down) stroke and acting on the surface area 208. Arrow 220 schematically illustrates a force ($F_5$) generated by product fluid and acting on the surface area 210. Arrows 215A and 215B schematically illustrate a force ($F_6$) generated by well fluid and acting on the surface area 205. Arrows 217A and 217B schematically illustrate a force ($F_7$) generated by well fluid acting on the surface area 207. Arrow 219 schematically illustrates a frictional force ($F_{r1}$) acting in a direction opposite of the direction of movement of the piston 103 within the pump 100.

FIG. 4B schematically illustrates the corresponding forces generated by the flow of power fluid and well fluid on the recovery (up) stroke. FIG. 4B shows the arrows 212A-B, 214A-B, 216A-B, 218A-B, 220, 215A-B, 217A-B, and 219 which schematically illustrate the forces $F_1$, $F_2$, $F_3$, $F_4$, $F_5$, $F_6$, $F_7$, and $F_{r1}$ respectively.

As shown in FIGS. 4A-B, on the power (down) stroke, a sum of the forces $F_1$, $F_5$, $F_6$, and $F_7$ and a weight of the piston W is greater than the sum of the forces $F_2$, $F_3$, and $F_4$ and $F_{r1}$. On the recovery (up) stroke, a sum of the forces $F_1$, $F_5$, $F_6$, $F_7$, and $F_{r1}$ is less than a sum of the forces $F_2$, $F_3$, and $F_4$.

To enclose chamber 140, the piston rod extends coaxially about chamber 140. The shapes of the pistons are chosen such that they form a slideable seal against the inner walls of the cylinder 101 (top cylinder 114, recovery cylinder 116, and pump cylinder 118). The spacing between components is typically determined by the seal utilized. The type of seal utilized is determined by the operating conditions (i.e. pressure and temperature) and the fluids utilized. In one embodiment, a standard O-ring seal is utilized. In high temperature applications, a ring such as those used in automobile pistons can be utilized.

FIG. 1 is a simplified drawing of a pump 100 of one embodiment. Seals and other conventional elements are omitted from the drawing for purposes of illustration. Numerous modifications can be made to the embodiment illustrated in FIG. 1. As just one example, the piston rod and blocks can vary in shape and thickness.

The operation of the pump illustrated in FIG. 1 is described in connection with pumping of oil from an oil well. However, the pumps of preferred embodiments are also suitable for pumping other liquids as well (e.g., ground water, subterranean liquids, brackish water, sea water, waste water, cooling water, gas, coolants, and the like).

The operating cycle of the pump can be divided into two separate stages, referred to as the power (down) stroke and the recovery (up) stroke. During the power (down) stroke, water or another power fluid enters via the power fluid line to chamber 130, as illustrated by arrow 170 in FIG. 2A. The fluid acts on the inner surface area 202, applying force $F_1$ to force the piston 103 down, opening the transfer check valve 160 and forcing well fluid from chamber 142 into chamber 140, as illustrated by arrows 182A-C, through the pump cylinder vents 146A-B into chamber 138, as illustrated by arrows 180A-B, through the recovery cylinder vents 156A-B into chamber 134, as illustrated by arrows 176A-B, from chamber 136 through piston rod vents 144A-B into chamber 140, as illustrated by arrows 178A-B, and from chamber 132 through the piston rod vents 124A-B into chamber 140, as illustrated by arrows 174A-B. The force $F_1$ can be provided at least in part by a power fluid drive system or power fluid drive site which can pressurize, pump, or otherwise displace power fluid through a power fluid line and into the chamber 130. Well fluid exits chamber 140 through the hub 108 to the product fluid line, illustrated by arrows 172A-D. This well fluid can then be recovered by suitable means or apparatus, such as known in the art. For example, the top block 102 can be connected to a pipe, which directs the well fluid to a desired location. Sometimes, the well fluid can be delivered to a wellhead, where the well fluid can be directed to separation and/or storage facilities. Storage facilities, when employed, can be either above ground or below ground. Where crude oil is recovered as the well fluid, the oil can be transferred to a refinery or refineries by pipeline, ship, barge, truck, or railroad. Where natural gas is recovered, the gas is typically transported to processing facilities by pipeline. Gas processing facilities are typically located nearby so impurities such as sulfur can be removed when possible. In cold climate applications, the oil can be transferred via heated lines.

During the recovery (up) stroke, fluid from the product fluid line enters the top block 102 and chamber 140, as illustrated by arrows 186A-C, for example, due to gravity acting on the fluid within the product fluid line. In certain embodiments, prior to or at the initiation of the recovery (up) stroke, pressure on the power fluid supplied by the power fluid drive system may be reduced or entirely removed. When fluid from the product fluid line enters the top block 102 and chamber 140, fluid within the chamber 140 is forced from chamber 140 into chamber 132 though the piston rod vents 124A-B, as illustrated by arrows 188B, and from chamber 140 into chamber 136 through piston rod vents 144A-B, as illustrated by arrows 192A-B. As described further herein, the flow of fluid from chamber 140 into chambers 132 and 136 forces the piston to translate upwards, whereby power fluid within the chamber 130 is forced through the passage 104 of the top block 102 to the power line by action of the piston. The piston also causes fluid to flow from chamber 134 out through the recovery cylinder vents 156A-B, as illustrated by arrows 190A-B and from the chamber 138 out through the pump cylinder vents 146A-B, as illustrated by arrows 194A and 194B. As the piston 103 rises, the intake check valve 162 opens, allowing well fluid to flow into chamber 142 through the intake check valve 162, as illustrated by arrow 198. As the piston rises with the transfer check valve 160 closed, a vacuum, partial vacuum or low pressure volume is created in chamber 142. The decrease in pressure causes the intake check valve 162 to open and well fluid to be drawn into the chamber 142 through the bottom block 120, as illustrated by arrow 198. The piston 103 rises until the top of one or more of the piston blocks 110, 126, and 150 contact an opposing surface (e.g., of the recovery cylinder 116, the top cylinder 114 or the top block 102), and/or until the total upward force ($F_u$) acting on the piston equals the total downward force ($F_d$) acting on the piston 103. As the piston 103 reaches the highest point (similar to top dead center for a piston in an engine), the chambers 134 and 148 are at their smallest volumes and chamber 142 is at its largest volume. The intake check valve 160 is open, but the transfer check valve 162 is closed.

During the recovery upstroke a total upward force $F_u$, provided at least partially by gravity action of the well fluid, as described herein, is greater than a total downward force $F_d$ acting on the piston.

During the recovery (up) stroke, the total upward force $F_u$ can be described as:

$$F_u=F_2+F_3+F_4=P_p*(A_2+A_3)+P_w*A_4 \quad \text{(Equation 1)}$$

During the recovery (up) stroke, the total downward force acting on the piston can be described as:

$$F_d=F_1+F_5+F_6+F_7+W+F_{r1}=P_d*A_1+P_p*A_5+P_w*(A_6+A_7)+W+F_{r1} \quad \text{(Equation 2)}$$

In Equations 1 and 2, as well as Equations 3 and 4 below, $P_d$ is the power fluid pressure, $P_p$ is the product fluid pressure, $P_w$ is the well fluid pressure, W is the piston block weight, $F_{r1}$ is the pump friction, $A_1$ is the area 202, $A_2$ is the area 204, $A_3$ is the area 206, and $A_5$ is the area 210, $A_6$ is the area 205, and $A_7$ is the area 207.

Following the recovery (up) stroke, pressure is then increased by the surface power unit increasing the force on area 202 ($A_1$) causing the piston to fall initiating the power stroke. In some embodiments, the pressure of the power fluid can be reduced such that the power fluid chamber serves as a vacuum or partial vacuum, providing an additional force to lower the piston 103.

During the power (down) stroke, the total upward force $F_u$ can be described as:

$$F_u=F_2+F_3+F_4+F_r=P_p*(A_2+A_3+A_4)+F_{r1} \quad \text{(Equation 3)}$$

During the power (down) stroke, the total downward force acting on the piston can be described as:

$$F_d=F_1+F_5+F_6+F_7+W=P_d*A_1+P_p*A_5+P_w*(A_6+A_7)+W \quad \text{(Equation 4)}$$

In some embodiments, the well fluid pressure $P_w$ is substantially smaller than the power fluid pressure $P_d$ and the product fluid pressure $P_p$. In some embodiments, the forces $F_6$ and $F_7$ may be negligible. Force $F_4$ may be negligible during the power (up) stroke. During the power (down) stroke, the force $F_5$ may be negligible. The force $F_5$ may be zero or close to zero.

The pressures and forces acting on the piston 103 during the power (down) stroke and recovery (up) stroke are described in Table 1.

TABLE 1

Figure 10:
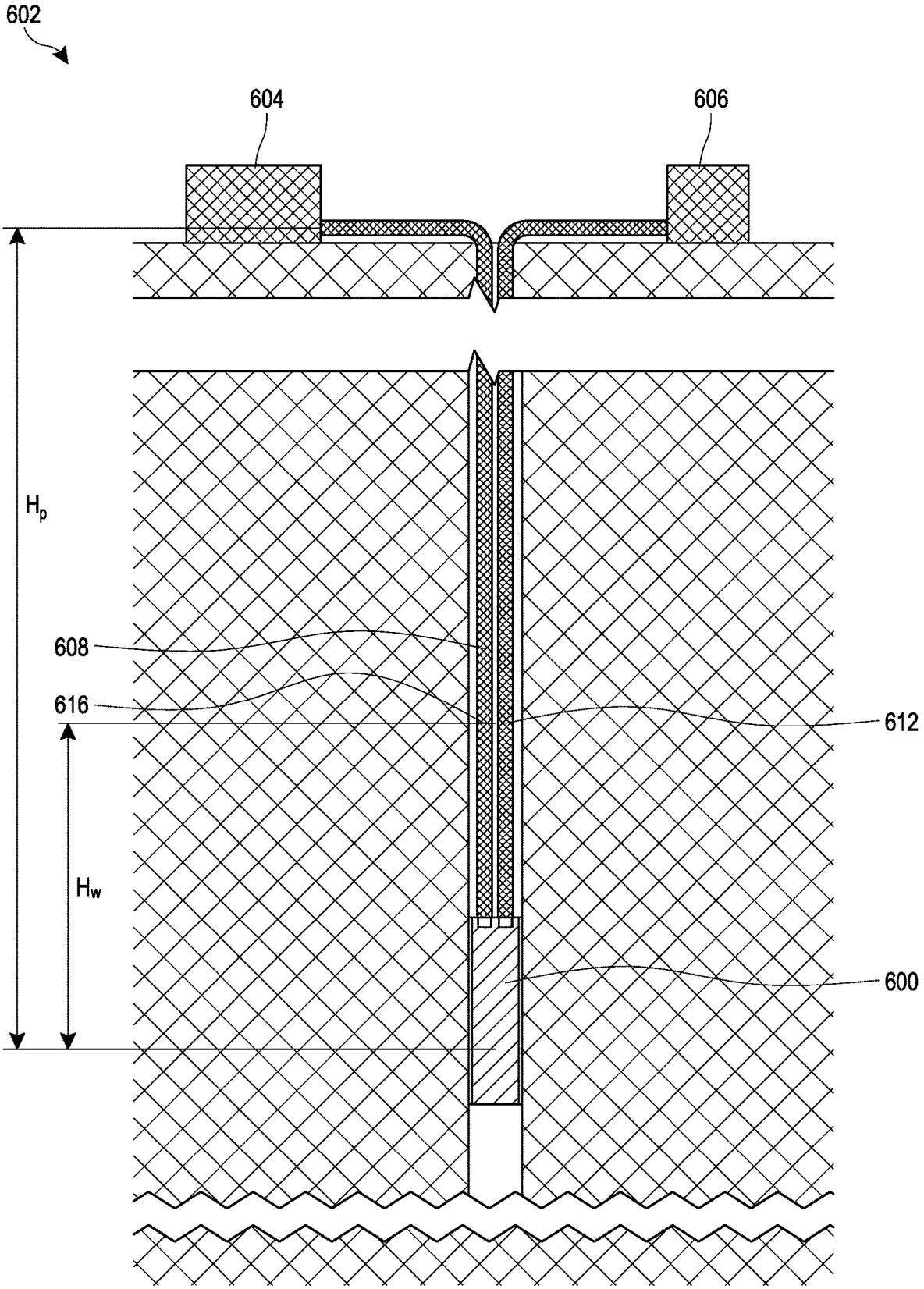
FIG. 10 provides a schematic illustrating the installation of a pump, such as the pump of FIG. 1, including placement of a power fluid line and a product fluid line in the well, and a power unit and product fluid unit at the surface.

| | | Stroke | | | |
|---|---|---|---|---|---|
| | | Power (Down) | | Recovery (Up) | |
| Label | Description | Equation | Notes | Equation | Notes |
| $P_d^o$ | Pressure created by power fluid drive unit | >> 0 | | = 0 | |
| $P_d^c$ | Power fluid column pressure | $= H_p * \rho * g$ | Hp—Depth of pump as shown in FIG. 10 | $= H_p * \rho * g$ | Hp—Depth of pump as shown in FIG. 10 |

TABLE 1-continued

| | | Stroke | | | |
|---|---|---|---|---|---|
| | | Power (Down) | | Recovery (Up) | |
| Label | Description | Equation | Notes | Equation | Notes |
| | | | ρ—Power fluid density<br>g—Acceleration of gravity | | ρ—Power fluid density<br>g—Acceleration of gravity |
| $P_d$ | Power fluid pressure on the piston | $= P_d^o + P_d^c$ | | $= P_d^c$ | |
| $P_p$ | Product fluid column pressure | $= H_p * \rho * g$ | Hp—Depth of pump as shown in FIG. 10<br>ρ—Product fluid density<br>g—Acceleration of gravity | $= H_p * \rho * g$ | Hp—Depth pump as shown in FIG. 10<br>ρ—Product fluid density<br>g—Acceleration of gravity |
| $P_w$ | Well fluid column pressure in the well | $= H_w * \rho * g$ | Hw—Well fluid level in the well as shown in FIG. 10<br>ρ—Well fluid density<br>g—Acceleration of gravity | $= H_w * \rho * g$ | Hw—Well fluid level in the well as shown in FIG. 10<br>ρ—Well fluid density<br>g—Acceleration of gravity |
| $F_1$ | | $= P_d * A_1$ | | $= P_d * A_1$ | |
| $F_2$ | | $= P_p * A_2$ | | $= P_p * A_2$ | |
| $F_3$ | | $= P_p * A_3$ | | $= P_p * A_3$ | |
| $F_4$ | | $= P_w * A_4$ | | $= P_p * A_4$ | |
| $F_5$ | | $= 0$ | | $= P_p * A_5$ | |
| $F_6$ | | $= P_w * A_6$ | | $= P_w * A_6$ | |
| $F_7$ | | $= P_w * A_7$ | | $= P_w * A_7$ | |
| $F_{r1}$ | | | | | |
| W | | | | | |

As the piston 103 lowers, the pressure inside chamber 142 increases. The increase in pressure causes the intake check valve 162 to close. Alternatively, sensors can be employed and the valves controlled electronically. As the pressure inside chamber 142 continues to increase due to the lowering piston, the transfer check valve 160 opens, thereby allowing well fluid located within chamber 142 to flow into chamber 140. The piston continues to lower until the piston block 150 of the bottom piston 152 contacts the bottom block 120, or alternatively the total upward force ($F_u$) acting on the piston equals the total downward force ($F_d$) acting on the piston 103.

The operation of the pump 100 is maintained by providing an oscillating or periodic pressure to the power fluid. As described herein, pressure on the power fluid is not required to raise the piston 103 on the recovery (up) stroke, which can allow the pump 100 to operate with a reduced energy consumption in comparison to a conventional pump. As described herein, the recovery (up) stroke can be driven substantially or at least partially by gravity acting on the product fluid in the pump 100.

The power fluid can be any suitable fluid. In one embodiment, the power fluid is water; however, numerous other power fluids can be utilized, including but not limited to sea water, waste water from oil recovery processes, and product fluid (i.e. oil if the pump is being used in oil recovery processes). In other embodiments, the power fluid can be gas or steam. Thus, the term "fluid," as used herein, is not restricted to liquids, but is intended to have a broad meaning, including gases and vapors. In one embodiment, the power fluid is air. In another embodiment, the power fluid is steam.

The appropriate power fluid for a particular application can be based on a variety of factors, including cost and availability, corrosiveness, viscosity, density, and operating conditions. For example, the power fluid can be the same fluid as the product fluid. This allows the product fluid and the power fluid to have the same density, thereby simplifying the forces acting on the transfer piston. Alternatively, a more dense power fluid can be utilized. Utilizing a power fluid that is more dense than the product fluid allows the pump to operate with either (a) the power fluid supplied at a lower pressure, or (b) a smaller inner surface area. For example, in some embodiments, brine or mercury can be utilized. Preferably, a low-viscosity power fluid is utilized, as use of a high viscosity power fluid may cause pressure loss due to friction between the power fluid and the power fluid column.

In some embodiments, such as where the pump is utilized in high temperature applications, a power fluid such as motor oil can be utilized. Similarly, various oils and liquids with low freezing points can be utilized in cold environments.

The pump can be operated by one power source, or a number of pumps can be operated by the same power source. For example, in some applications such as construction, mine dewatering, or other commercial and industrial applications, several pumps can be operated by the same power source. In addition, several pumps can be operated using an air system, such as in a manufacturing facility.

The pump and its components can be any suitable shape. The use of the terms chamber, piston blocks, piston rod, valves, and the like are not intended to limit the shape of the components. Rather, these terms are used solely to aid in describing particular embodiments. For example, with reference to FIG. 1, the cylinders, pistons, and rod can be substantially cylindrical in shape. Thus, the pistons seal the annular gap with the inner surface of the cylinders. However, the pumps of preferred embodiments are not limited to this configuration. For example, besides being formed in a circular shape, the pump components can also be square, rectangular, triangular, or elliptical.

The pump components, such as the cylinders, pistons, and rod, can be constructed of any suitable material. For example, in preferred embodiments, these components can be constructed of 304 or 316 stainless steel. In some embodiments, such as when the pump is in contact with highly corrosive materials, a 400 series stainless steel can be used. One of skill in the art will appreciate that selection of the pump materials depends on a variety of factors, including strength, corrosion resistance, and cost. In high temperature applications, pump components can preferably be constructed of ceramic, carbon fiber, or other heat resistant materials.

Referring still to FIG. 1, the upper surfaces of the top piston 112 define an area 402. This upper surface can be planar, but can also be concave, convex, or linearly sloping. The surface area 402 supports the weight of the power fluid and any standing column of power fluid above the pump to create a downward force on the pistons. This downward force is equal to the pressure of the power fluid in the chamber multiplied by the surface area 402. Gravity acting on the weight of the piston also creates a downwards force, described as W, in Equations 1 and 2.

As described herein, the surfaces of the pistons 112, 128, and 152 are exposed to the fluid in the chambers 130, 132, 134, 136, 138, 140, and 142, and also define areas 202, 204, 205, 206, 207, 210, and 208, respectively. Fluid in chambers 130, 132, 134, 136, 138, 140, and 142 exert forces on the piston 103 equal to the pressures inside the chambers multiplied by their respective surface areas 202, 204, 205, 206, 207, 210, and 208, upon which they each act. Accordingly, changes to the values for the surface areas influence the amount of pressure required to cause movement of the piston 103 during the power (down) stroke or recovery (up) stroke. For the power (down) stroke, the work required to lower the piston is determined by multiplying the force exerted by the power fluid by the distance the piston travels.

Figure 5:
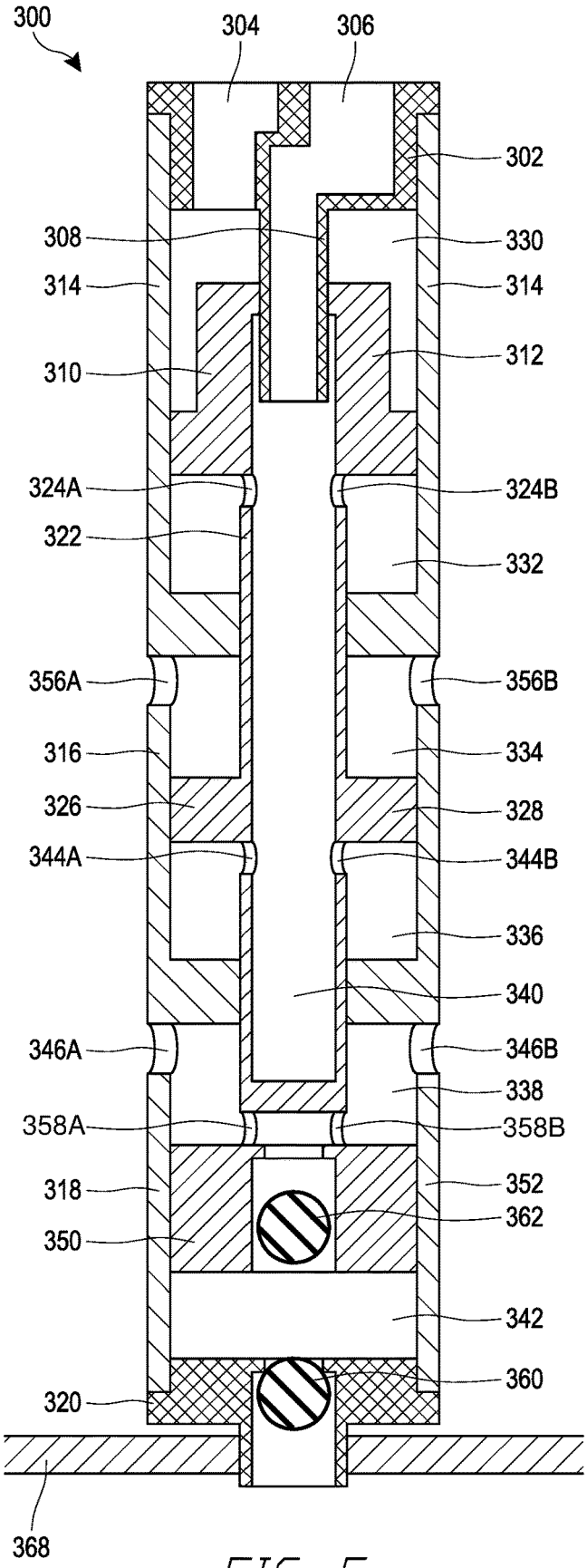
FIG. 5 provides a cross-sectional view of a second embodiment of a high production discharge pump for a packered well.

FIG. 5 illustrates another embodiment of a pump 300. The pump is, in many respects, similar to the embodiment described above in connection with FIG. 1, but is configured for use in conjunction with a packer and utilizes a counterbalance fluid in addition to the power fluid. The pump 300 includes a top block 302 with a passage 304 allowing fluid communication with a power fluid line (not shown) and a passage 306 allowing fluid communication with a counterbalance fluid line (not shown), as well as a hub 308 extending into a piston block 310 of a top piston 312. The top block 302 is seated in a top cylinder 314, which is adjacent to a recovery cylinder 316 and a pump cylinder 318. A bottom block 320 is set in the pump cylinder 318. The top cylinder 314 houses the piston block 310 of the top piston 312, which is supported by a piston rod 322 having vents 324A-B to a chamber 332.

The chamber 332 is encompassed by the top cylinder 314, the piston rod 322, and the piston block 310. Surfaces of the top piston 312, the top block 302, and hub 308 enclose chamber 330. The recovery cylinder 316 includes recovery cylinder vents 356A-B. A piston block 326 of a recovery piston 328, the top cylinder 314, and the recovery cylinder 316 encompass a chamber 334. The piston rod 328 housed in the recovery cylinder 316 includes piston rod vents 344A-B to a chamber 336. The chamber 336 is encompassed by the recovery piston block 326, a piston rod 348, and the recovery cylinder 316. The pump cylinder 318 includes pump cylinder vents 346A-B. The piston rod 348 in the pump cylinder 318, the recovery cylinder 316, and a bottom piston block 350 of a bottom piston 352 encompass a chamber 338. The piston rod 348 included piston rod vents 358A-B between chamber 338 and an intake check valve 362. The interior of the piston rods and the interior of the passage 306 of hub 308, which leads to the counterbalance fluid line, encompass a chamber 340.

The top piston 312, recovery piston 328, and bottom piston 352 collectively form a piston 303. In certain embodiments, the top piston 312, the recovery piston 328, and the bottom piston 352 may be sections forming a single piston 303 of the pump 300. In other embodiments, the top piston 312, the recovery piston 328, and the bottom piston 352 of the piston 303 may be separate piston components.

The top cylinder 314, the recovery cylinder 316, and the pump cylinder 318 collectively form a cylinder 301. In certain embodiments, the top cylinder 314, the recovery cylinder 316, and the pump cylinder 318 may be sections forming a single cylinder 301 of the pump 300. In other embodiments, the top cylinder 314, the recovery cylinder 316, and the pump cylinder 318 of the cylinder 101 may be separate cylinder components.

Below the bottom of chamber 340, an intake check valve 362 is provided. The intake check valve 362 seats at the top of the piston block 350. The bottom of the intake check valve 362, the bottom piston block 350 and the bottom block 320 encompass chamber 342. In the packer configuration of FIG. 5, a transfer check valve 360 seats at the top of the bottom block 320.

The intake check valve 362 and transfer check valve 360 are one-way valves, allowing fluid to flow through the intake check valve 362 into chamber 342 and through the transfer check valve 360 and out of the pump 100, respectively, but not in the reverse direction. The transfer check valve 360 and intake check valve 362 can be self-actuating valves, such that they require no electronic or manual control, but rather open and close solely by the force of the fluid moving therethrough and/or by pressure changes in chamber 342. In such embodiments, any suitable type of one-way valve can be utilized, including check valves and the like.

Check valves are valves that permit fluid to flow in only one direction. In certain embodiments, as shown in FIG. 5, one or both of the transfer check valve 360 and the intake check valve 362 can be ball check valves. Ball check valves contain a ball that sits freely above a seat, which has only one opening therethrough. The ball has a diameter that is larger than the diameter of the opening. When the pressure behind the seat exceeds the pressure above the ball, liquid is allowed to flow through the valve; however, once the pressure above the ball exceeds the pressure below the seat, the ball returns to rest in the seat, forming a seal that prevents backflow. The ball can also be connected to a spring or other alignment device. Such alignment devices are useful if the pump operates in a non-vertical orientation. In some embodiments, the ball can be replaced by another shape, such as a cone.

Swing check valves can also be utilized. Swing check valves use a hinged disc that swings open with the flow. Any other suitable type of check valve, including dual flap check valves and lift check valves, can also be utilized. Numerous other types of valves can be utilized, including reed valves, diaphragm valves. The valves can optionally be electronically controlled. Using standard computer process control techniques, such as those known in the art, the opening and closing of each valve can be automated. In such embodiments, two-way valves can advantageously be utilized.

While FIG. 5 depicts one intake and one transfer check valve, any suitable number of valves can be employed, for example, 1, 2, 3, 4, 5, or more intake check valve, and 1, 2, 3, 4, 5, or more transfer check valve.

The pump 300 can be of any suitable size. The preferred size can be selected based upon various factors such as the amount of liquid to be pumped, the type of liquid, and other factors. For example, the pump cylinder 118 can have a diameter of 1, 3, 6, 12, 24, or 36 inches or more.

The pump 300 also includes the piston 303 having piston block portions (top piston 312, recovery piston 328, bottom piston 350) and rod portion including vents (piston rod vents 324A-B into chamber 332, piston rod vents 344A-B into chamber 336, and piston rod vents 358A-B into chamber 338). The piston 303 includes the center chamber (chamber 340) and the intake check valve 362. Preferably, the intake check valve 362 is a one-way valve, allowing fluid to flow from chamber 338 into chamber 342, but not in the reverse direction. In certain embodiments, the piston 303 is reciprocatingly mounted in the pump 300.

Figure 6B:
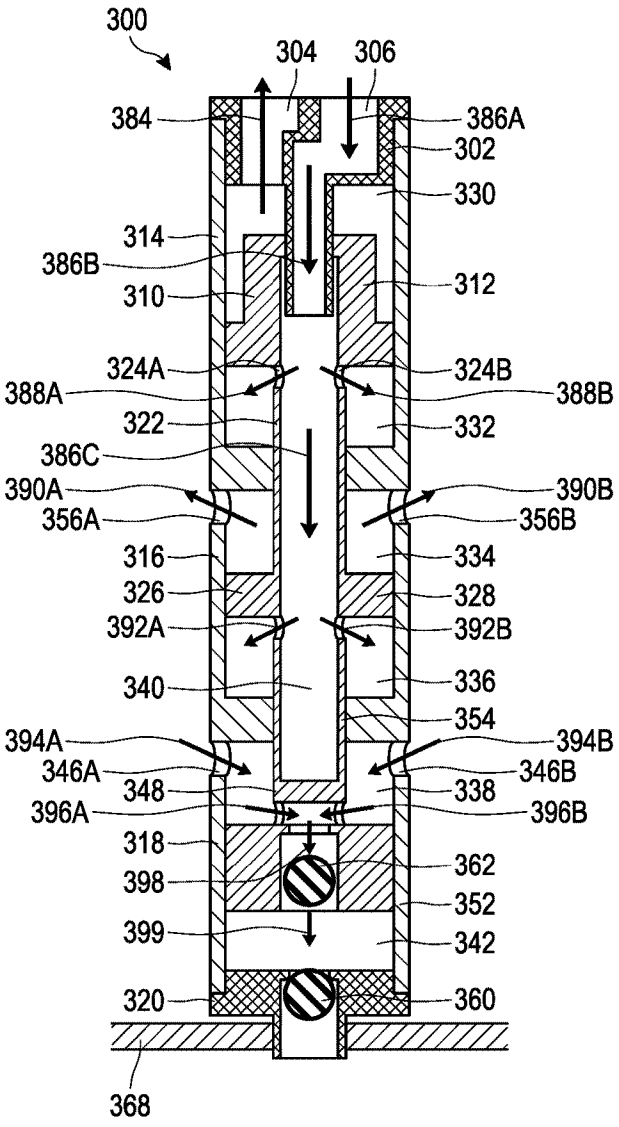
FIGS. 6A-B provides cross-sectional views of the pump of FIG. 5, showing flow of power fluid, well fluid, and counter-balance fluid on the power (down) stroke and on the recovery (up) stroke.
Figure 6A:
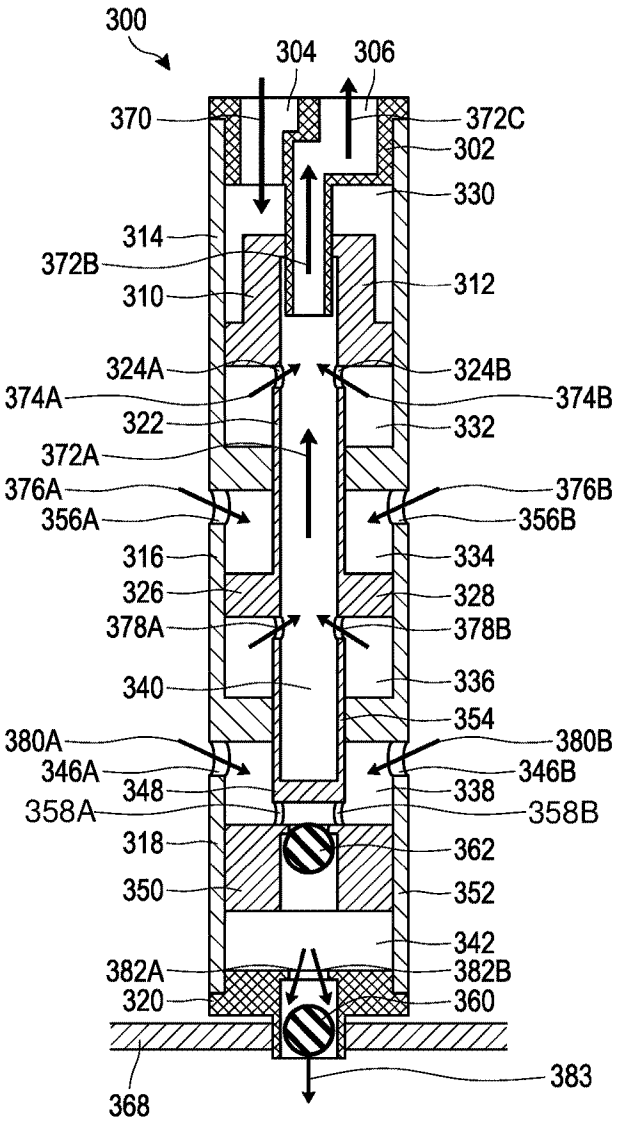

The pump 300 can operate at any angle, including vertical, horizontal, or any angle there between. The passage 304 comprises an inlet to the power line such that power fluid can be provided to and/or removed from the pump 300 through the top block 302. FIG. 6A illustrates the flow of power fluid, well fluid, product fluid, and counterbalance fluid on a power (down) stroke. As described in further detail herein, an arrow 370 indicates the direction of flow of power fluid during a power (down) stroke. Arrows 376A-B and 380A-B, indicate the direction of flow of well fluid within the pump 300 during a power (down) stroke. Arrows 382A-B and 383 indicated the direction of flow of product fluid during a power (down) stroke. Arrows 372A-C, 374A-B, and 378A-B indicate the direction of flow of counterbalance fluid during a power (down) stroke.

Figure 7B:
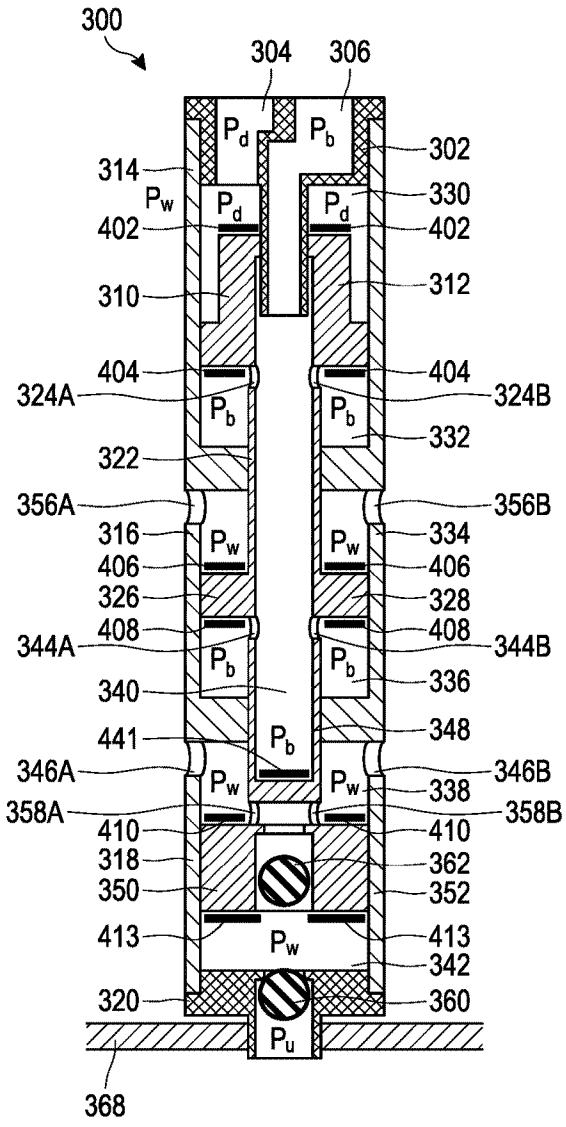
FIGS. 7A-B provides cross-sectional views of the pump of FIG. 5, showing surface areas and pressure on surfaces of the pump on the power (down) stroke and on the recovery (up) stroke.

FIG. 7B illustrates the flow of power fluid, the flow of well fluid, and the flow of counterbalance fluid on a recovery (up) stroke. As described in further detail herein, an arrow 384 indicates the direction of flow of power fluid during the recovery (up) stroke. Arrows 390A-B, 394A-B, 396A-B, 398, and 399 indicate the direction of the flow of well fluid during the recovery (up stroke). Arrows 386A-C, 388A-B, and 392A-B indicate the direction of the flow of counterbalance fluid during the recovery (up) stroke.

Figure 7A:
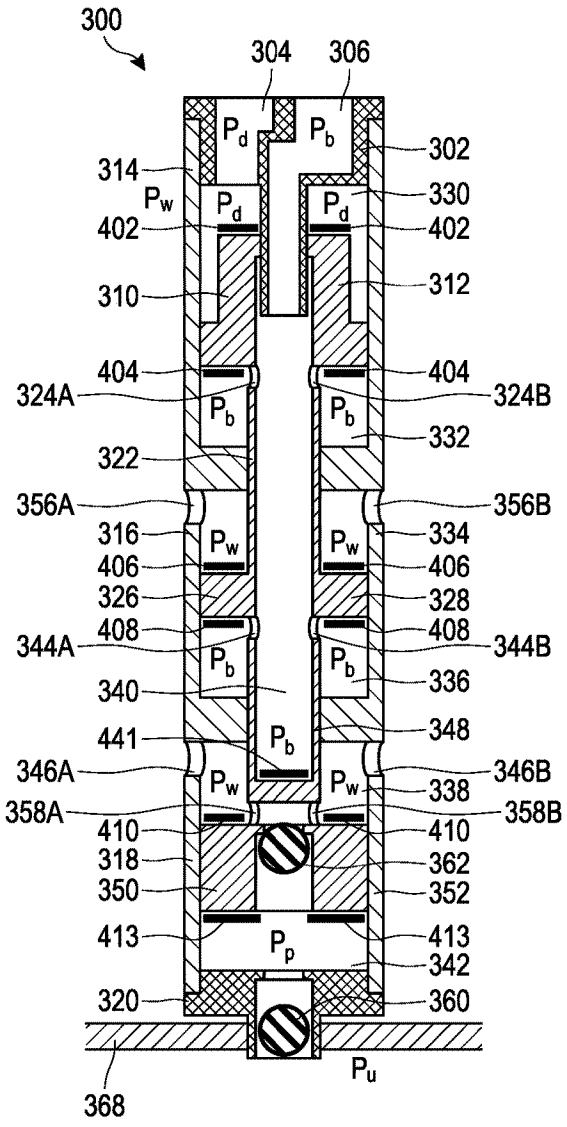

FIG. 7A illustrates surfaces within the pump 300 on which the power fluid, well fluid, product fluid, and counterbalance fluid act during the power (down) stroke. FIG. 7B illustrates surfaces within the pump 300 on which the power fluid, well fluid, product fluid, and counterbalance fluid act during the recovery (up) stroke. In the embodiment illustrated in FIG. 5, the power fluid chamber (chamber 330) is defined by surfaces of the hub 308, the top piston 312, and the interior surface of the top cylinder 314. The surface area upon which the power fluid acts is identified in FIG. 7A as area 402, while the surface areas upon which the well fluid on the power (down) stroke acts are identified as areas 406, 410. The surface area upon which the product fluid acts during the power (down) stroke is identified as surface area 413. The surface areas upon which the counterbalance fluid act are identified as areas 404, 408, and 411.

The surfaces of the piston experience pressure due to forces exerted by the drive site, the counterbalance site, and the well. Pressure from the power fluid, counterbalance fluid, product fluid, and well fluid, identified respectively, as $P_d$, Pb, $P_p$, and $P_w$, are shown schematically in FIGS. 7A-B.

The surface areas upon which the well fluid on the recovery (up) stroke acts are identified as area 406, area 410, and area 413 in FIG. 7B. The surface area upon which the power fluid acts is identifies as area 402 in FIG. 7B. The surface areas upon which the counterbalance fluid acts during the recovery (up) stroke are identified as areas 404, 408, and 411.

Figure 8B:
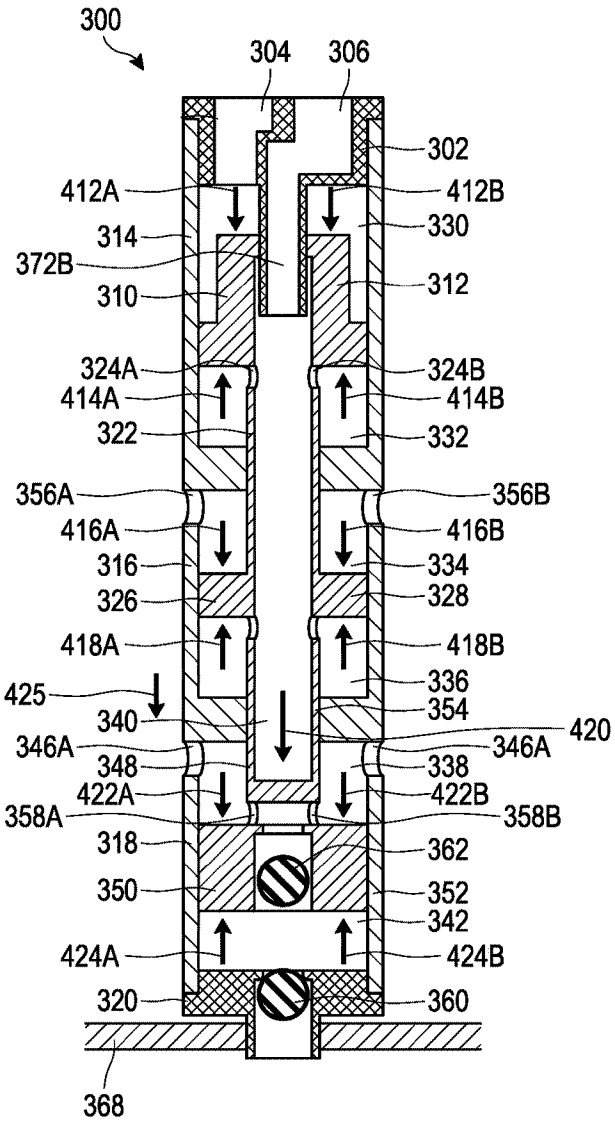
FIGS. 8A-B provide cross-sectional views of the pump of FIG. 5, showing forces applied to the piston on the power (down) stroke and on the recovery (up) stroke.
Figure 8A:
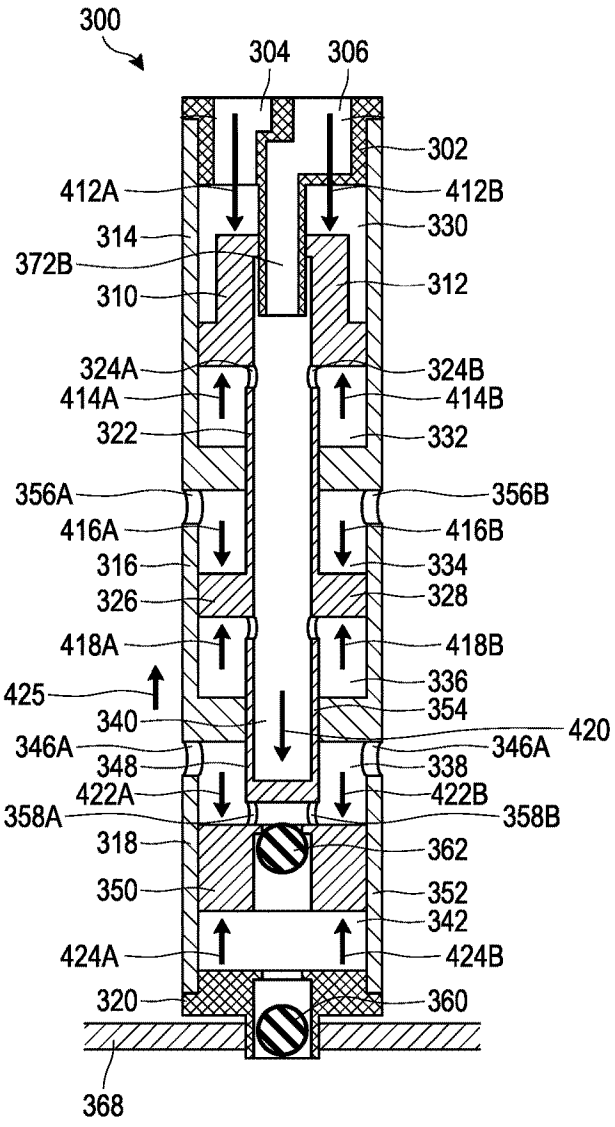

FIG. 8A schematically illustrates the corresponding forces generated by the flow of power fluid, well fluid, product fluid, and counterbalance fluid on the power (down) stroke. Arrows 412A and 412B schematically illustrate a force ($F_8$) generated by the flow of power fluid on the power (down) stroke and acting on the surface area 402. Arrows 414A and 414B schematically illustrate a force ($F_9$) generated by the flow of counterbalance fluid on the power (down) stroke and acting on the surface area 404. Arrows 416A and 216B schematically illustrate a force ($F_{10}$) generated by the flow of well fluid on the power (down) stroke and acting on the surface area 406. Arrows 418A-B schematically illustrate a force ($F_{11}$) generated by the flow of counterbalance fluid on the power (down) stroke and acting on the surface area 408. Arrow 420 schematically illustrates a force ($F_{12}$) generated by the flow of counterbalance fluid on the power (down) stroke and acting on the surface area 411. Arrows 422A-B schematically illustrate a force ($F_{13}$) generated by the flow of well fluid on the power (down) stroke and acting of the surface area 410. Arrows 424A-B schematically illustrate a force ($F_{14}$) generated by the product line fluid on the power (down) stroke and acting on the surface area 413. Arrow 425 schematically illustrates a frictional force ($F_{r2}$) acting in the direction opposite of the direction of the piston in the pump 100.

FIG. 8B schematically illustrates the corresponding forces generated by the flow of power fluid, well fluid, and counterbalance fluid on the recovery (up) stroke. As shown in FIGS. 8A-B, the sum of the forces $F_8$, $F_{10}$, $F_{12}$, and $F_{13}$ and weight of the piston W generated during the power (down) stroke is greater than the sum of the forces $F_9$, $F_{11}$, $F_{14}$ and $F_{r2}$. On the recovery (up) stroke, the sum of the forces $F_8$, $F_{10}$, $F_{12}$, $F_{13}$, and $F_{r2}$ and weight of the piston W is less than the sum of the forces $F_9$, $F_{11}$, and $F_{14}$.

To enclose chamber 340, the piston rod extends coaxially about chamber 340. The shapes of the pistons are chosen such that they form a slideable seal against the inner walls of the cylinder 301 (top cylinder 314, recovery cylinder 316, and pump cylinder 318). The spacing between components is typically determined by the seal utilized. The type of seal utilized is determined by the operating conditions (i.e. pressure and temperature) and the fluids utilized. In one embodiment, a standard O-ring seal is utilized. In high temperature applications, a ring such as those used in automobile pistons can be utilized.

FIG. 5 is a simplified drawing of a pump 300 of one embodiment. Seals and other conventional elements are omitted from the drawing for purposes of illustration. Numerous modifications can be made to the embodiment illustrated in FIG. 5. As just one example, the piston rod and blocks can vary in shape and thickness.

The operation of the pump illustrated in FIG. 5 is described in connection with pumping of oil from an oil well. However, the pumps of preferred embodiments are also suitable for pumping other liquids as well (e.g., ground water, subterranean liquids, brackish water, sea water, waste water, cooling water, gas, coolants, and the like).

The operating cycle of the pump can be divided into two separate stages, referred to as the power (down) stroke and the recovery (up) stroke. During the power (down) stroke, water or another power fluid enters via the power fluid line to chamber 330, as illustrated by arrow 370 in FIG. 6A. The fluid acts on the inner surface area 402, applying force $F_8$ to force the piston down, opening the transfer check valve 360 and forcing fluid from chamber 342 out of the pump 300, as illustrated by arrows 382A-B and 383, through the pump cylinder vents 346A-B into chamber 338, as illustrated by arrows 380A-B, through the recovery cylinder vents 356A-B into chamber 334, as illustrated by arrows 376A-B, from chamber 336 through piston rod vents 344A-B into chamber 340, as illustrated by arrows 378A-B, and from chamber 332 through the piston rod vents 324A-B into chamber 340, as illustrated by arrows 374A-B. The force $F_8$ can be provided at least in part by a power fluid drive system or power fluid drive site which can pressurize, pump, or otherwise displace power fluid through a power fluid line and into the chamber 330. Counterbalance fluid exits chamber 340 through the hub 308 to the counterbalance fluid line, illustrated by arrows 372A-C.

During the recovery (up) stroke, counterbalance fluid from the counterbalance fluid line enters the top block 302 and chamber 340, as illustrated by arrows 386A-B. In certain embodiments, prior to or at the initiation of the recovery (up) stroke, pressure on the power fluid supplied by the power fluid drive system may be reduced or entirely removed. In certain embodiments, counterbalance fluid enters the counterbalance fluid line due to gravity acting on the counterbalance fluid. In certain embodiments, a driving force is applied to the counterbalance fluid to cause the counterbalance fluid to enter the counterbalance fluid line through the passage 306. When counterbalance fluid enters the top block 302 and chamber 340, fluid within the chamber 340 is forced from chamber 340 into chamber 332 though the piston rod vents 324A-B, as illustrated by arrows 388B, and from chamber 340 into chamber 336 through piston rod vents 344A-B, as illustrated by arrows 392A-B. As described further herein, the flow of fluid from chamber 340 into chambers 332 and 336 causes the piston 303 to translate upwards, whereby power fluid within the chamber 330 is displaced through the passage 304 of the top block 302 to the power line by action of the piston. The piston 303 also causes fluid to flow from chamber 334 out through the recovery cylinder vents 356A-B, as illustrated by arrows 390A-B, into the chamber 338 through the pump cylinder vents 346A-B, as illustrated by arrows 394A-B. As the piston rises, the intake check valve 362 opens, allowing well fluid to flow into chamber 342 from the chamber 338 through the vents 358A-B and through the intake check valve 362, as illustrated by arrows 396A-B, 398, and 399. As the piston rises with the transfer check valve closed, a vacuum, partial vacuum or low pressure volume is created in chamber 342. The decrease in pressure causes the intake check valve 362 to open and well fluid to be drawn into the chamber 342 through the intake check valve 362 in the piston block 350.

The piston rises until the top of one or more of the piston blocks 310, 326, and 350 contact an opposing surface (e.g., of the recovery cylinder 316, the top cylinder 314 or the top block 302), and/or until the total upward force ($F_u$) acting on the piston 303 equals the total downward force ($F_d$) acting on the piston 303. As the piston 303 reaches the highest point, the intake check valve 362 is open, but the transfer check 360 valve is closed.

During the recovery (up) stroke the total upward force $F_u$ is greater than a total downward force $F_d$ acting on the piston.

During the recovery (up) stroke, the total upward force $F_u$ can be described as:

$$F_u=F_9+F_{11}+F_{14}=P_b*(A_9+A_{11})+P_w*A_{14} \quad \text{(Equation 5)}$$

The total downward force $F_d$ acting on the piston can be described as:

$$F_d=F_8+F_{10}+F_{12}+F_{13}+W+F_{r2}=P_d*A_8+P_w*(A_{10}+A_{13})+P_b*A_{12}+W+F_{r2} \quad \text{(Equation 6)}$$

In Equations 5 and 6, as well as equations 7 and 8 below, $P_d$ is the power fluid pressure, $P_p$ is the product fluid pressure, $P_w$ is the well fluid pressure, $P_b$ is the counterbalance fluid pressure, W is the piston block weight, $F_{r2}$ is the pump friction, $A_8$ is the area 402, $A_9$ is the area 404, $A_{10}$ is the area 406, $A_{11}$ is the area 408, $A_{12}$ is the area 411, $A_{13}$ is the area 410, and $A_{14}$ is the area 413.

Following the recovery (up) stroke, pressure is then increased by the surface power unit increasing the force on area 402 ($A_8$) causing the piston to fall initiating the power stroke. In some embodiments, the pressure of the power fluid can be reduced such that the power fluid chamber serves as a vacuum or partial vacuum, providing an additional force to lower the piston.

During the power (down) stroke, the total upward force $F_u$ can be described as:

$$F_u=F_9+F_{11}+F_{14}+F_{r2}=P_b*(A_9+A_{11})+P_p*A_{14}+F_{r2} \quad \text{(Equation 7)}$$

During the power (down) stroke, the total downward force acting on the piston can be described as:

$$F_d=F_8+F_{10}+F_{12}+F_{13}+W=P_d*A_8+Pw*(A_{10}+A_{13})+P_b*A_{12}+W \quad \text{(Equation 8)}$$

As the piston 303 lowers, the pressure inside chamber 342 increases. The increase in pressure causes the intake check valve 362 to close. Alternatively, sensors can be employed and the valves controlled electronically. As the pressure inside chamber 342 continues to increase due to the lowering piston, the transfer check valve 360 opens, thereby allowing well fluid located within chamber 342 to flow out of the pump 300. The piston continues to lower until the piston block 350 of the bottom piston 352 contacts the bottom block 320, or alternatively until the sum of the forces $F_8$, $F_{10}$, $F_{12}$, and $F_{13}$ is equal to the sum of the forces $F_9$, $F_{11}$, and $F_{14}$.

In some embodiments, the well fluid pressure $P_w$ is substantially smaller than the power fluid pressure $P_d$, the product fluid pressure $P_p$, and the counterbalance fluid pressure $P_b$. In some embodiments, the forces $F_{10}$ and $F_{14}$ may be negligible. During the recovery (up) stroke, the force $F_{14}$ may be negligible.

The pressures and forces acting on the piston 303 during the power (down) stroke and recovery (up) stroke are described in Table 2.

TABLE 2

Figure 9:
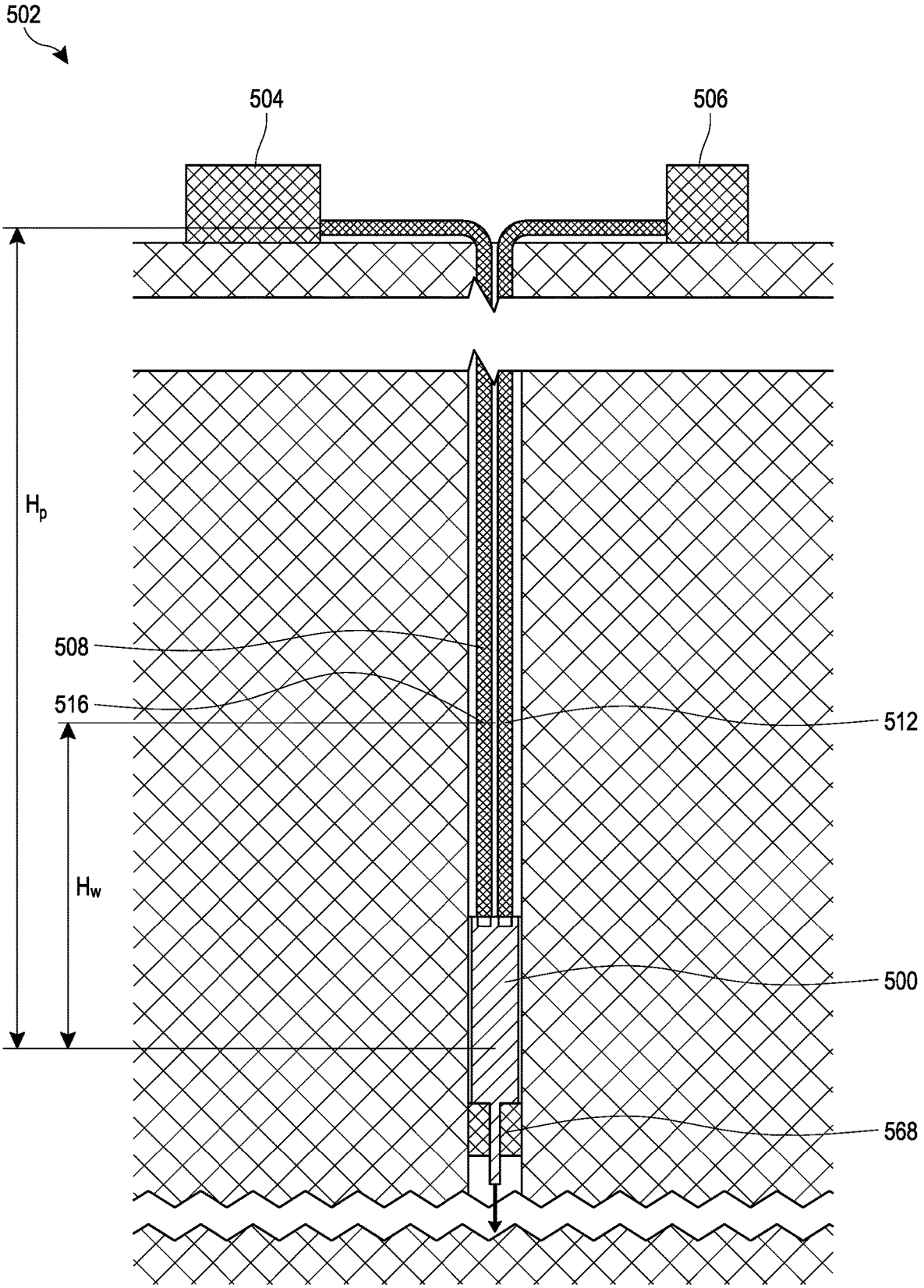
FIG. 9 provides a schematic illustrating the installation of a pump, such as the pump of FIG. 5, including placement of the packer, power fluid line, and counter-balance line in the well, and a power unit, and counter-balance fluid source at the surface.

| | | Stroke | | | |
|---|---|---|---|---|---|
| | | Power (Down) | | Recovery (Up) | |
| Label | Description | Equation | Notes | Equation | Notes |
| $P_d^o$ | Pressure created by the power fluid drive unit | >> 0 | | = 0 | |
| $P_d^c$ | Power column pressure | $= H_p * \rho * g$ | Hp—Depth of pump as shown in FIG. 9<br>ρ—Power fluid density<br>g—Acceleration of gravity | $= H_p * \rho * g$ | Hp—Depth of pump as shown in FIG. 9<br>ρ—Power fluid density<br>g—Acceleration of gravity |
| $P_d$ | Power fluid pressure on the piston | $= P_d^o + P_d^c$ | | $= P_d^c$ | |
| $P_b$ | Counter-balance fluid column pressure | $= H_p * \rho * g$ | Hp—Depth of pump as shown in FIG. 9<br>ρ—Counter-balance fluid density<br>g—Acceleration of gravity | $= H_p * \rho * g$ | Hp—Depth of pump as shown in FIG. 9<br>ρ—Counter-balance fluid density<br>g—Acceleration of gravity |
| $P_w$ | Well fluid column pressure in the well | $= H_p * \rho * g$ | Hw—Well fluid level as shown in FIG. 9<br>ρ—Well fluid density<br>g—Acceleration of gravity | $= H_p * \rho * g$ | Hp—Well fluid level as shown in FIG. 9<br>ρ—Well fluid density<br>g—Acceleration of gravity |
| $P_u$ | Well fluid pressure bellow the packer | | | | |
| $F_8$ | | $= P_a * A_8$ | | $= P_a * A_8$ | |
| $F_9$ | | $= P_b * A_9$ | | $= P_b * A_9$ | |
| $F_{10}$ | | $= P_w * A_{10}$ | | $= P_w * A_{10}$ | |
| $F_{11}$ | | $= P_b * A_{11}$ | | $= P_b * A_{11}$ | |
| $F_{12}$ | | $= P_b * A_{12}$ | | $= P_b * A_{12}$ | |
| $F_{13}$ | | $= P_w * A_{13}$ | | $= P_w * A_{13}$ | |
| $F_{14}$ | | $= P_p * A_{14}$ | | $= P_w * A_{14}$ | |
| $F_{r2}$ | | | | | |
| W | | | | | |

The operation of the pump is maintained by providing an oscillating or periodic pressure to the power fluid. As described herein, pressure on the power fluid is not required to raise the piston 303 on the recovery (up) stroke, which can allow the pump 100 to operate with a reduced energy consumption in comparison to a conventional pump. As described herein, the recovery (up) stroke can be driven substantially or at least partially by gravity acting on the counterbalance fluid in the pump 300.

The power fluid can be any suitable fluid. In one embodiment, the power fluid is water; however, numerous other power fluids can be utilized, including but not limited to sea water, waste water from oil recovery processes, and product fluid (i.e. oil if the pump is being used in oil recovery processes). In other embodiments, the power fluid can be gas or steam. Thus, the term "fluid," as used herein, is not restricted to liquids, but is intended to have a broad meaning, including gases and vapors. In one embodiment, the power fluid is air. In another embodiment, the power fluid is steam.

The appropriate power fluid for a particular application can be based on a variety of factors, including cost and availability, corrosiveness, viscosity, density, and operating conditions. For example, the power fluid can be the same fluid as the product fluid. This allows the product fluid and the power fluid to have the same density, thereby simplifying the forces acting on the transfer piston. Alternatively, a more dense power fluid can be utilized. Utilizing a power fluid that is more dense than the product fluid allows the pump to operate with either (a) the power fluid supplied at a lower pressure, or (b) a smaller inner surface area. For example, in some embodiments, brine or mercury can be utilized. Preferably, a low-viscosity power fluid is utilized, as use of a high viscosity power fluid may cause pressure loss due to friction between the power fluid and the power fluid column.

In some embodiments, such as where the pump is utilized in high temperature applications, a power fluid such as motor oil can be utilized. Similarly, various oils and liquids with low freezing points can be utilized in cold environments.

The pump can be operated by one power source, or a number of pumps can be operated by the same power source. For example, in some applications such as construction, mine dewatering, or other commercial and industrial applications, several pumps can be operated by the same power source. In addition, several pumps can be operated using an air system, such as in a manufacturing facility.

The pump and its components can be any suitable shape. The use of the terms chamber, piston blocks, piston rod, valves, and the like are not intended to limit the shape of the components. Rather, these terms are used solely to aid in describing particular embodiments. For example, with reference to FIG. 5, the cylinders, pistons, and rod can be substantially cylindrical in shape. Thus, the pistons seal the annular gap with the inner surface of the cylinders. However, the pumps of preferred embodiments are not limited to this configuration. For example, besides being formed in a circular shape, the pump components can also be square, rectangular, triangular, or elliptical.

The pump components, such as the cylinders, pistons, and rod, can be constructed of any suitable material. For example, in preferred embodiments, these components can be constructed of 304 or 316 stainless steel. In some embodiments, such as when the pump is in contact with highly corrosive materials, a 400 series stainless steel can be used. One of skill in the art will appreciate that selection of the pump materials depends on a variety of factors, including strength, corrosion resistance, and cost. In high temperature applications, pump components can preferably be constructed of ceramic, carbon fiber, or other heat resistant materials.

FIG. 9 depicts an installation 502 of a packered well pump 500, which can be similar to or the same as the puckered well pump 300 as shown in FIG. 5. FIG. 9 depicts the relative locations of components in the well, including a packer 568, the pump 500, a power line 510, a counter balance line 512, a surface source of power fluid 504, and a surface source of counter-balance fluid 506. The pump 500 is positioned at a depth H p from the surface. The level of well fluid within the well is shown as H.

FIG. 10 depicts an installation 602 of a well pump 600, which can be similar to or the same as the well pump 100 as shown in FIG. 1. FIG. 10 depicts the relative locations of components in the well, including the pump 600, a power line 610, a product fluid line 612, a surface source of power fluid 604, and a surface source of product fluid 606. The pump 600 is positioned at a depth H p from the surface. The level of well fluid within the well is shown as H.

In certain embodiment, the speed at which a pump, such pumps 100, 300, and 500, operates can be varied as desired. The time required for one "stroke," which is defined as the piston moving from its lowest position, through its highest position and returning to its lowest position, can be set by the operator. For the embodiment described above, wherein the outer diameter of the pump is about 1.5 inches, a preferred speed is about 6 strokes per minute, which provides a displaced volume of about three barrels per day. However, any range of speeds can be utilized depending upon the application. For example, in some embodiments, only one stroke per minute can be employed. In other applications, speeds of 20 strokes per minute or more can be employed. The volume of product fluid pumped is determined by the speed of the pump and the length of the stroke. Any suitable stroke length can be utilized, including 6, 12, 24, or 36 inches or more.

The operating cycle of the pump is maintained by providing an oscillating pressure to the power fluid. This oscillating pressure can be provided by any suitable method, including a number of methods known in the art. Among such methods are those described below and those disclosed in United States Patent Publication No. 2005-0169776-$A_1$, the contents of which are incorporated herein by reference in its entirety.

For example, the oscillating pressure can be provided by a piston and cylinder system, wherein the piston is moved by a motor or engine with a crank mechanism, or a pneumatic or hydraulic device. These systems can be controlled manually, by an electronic timer, by a programmable logic controller ("PLC"), by computer, or by a pendulum. A conduit can deliver power fluid to from a power fluid source. The power fluid source can comprise a cylinder and a power fluid piston. During the power stroke, the power fluid piston moves to one side, forcing power fluid from the power fluid cylinder, to the power line. This increases the power fluid pressure inside the pump, thereby lifting the piston. During the recovery stroke, the power fluid piston moves to the other side. Power fluid is forced out, and the piston lowers.

In some applications, the power fluid in the power line alone can provide substantial pressure. For example, the power source can be a fluid source stored at an elevation that is higher than that where the product fluid is recovered. The difference in elevation provides a natural source of pressure. During the power stroke, a valve in the line is opened, allowing power fluid to flow from the power fluid source, through the power line, and into pump. The difference in elevation alone can cause the piston to rise and pump fluid out at the recovery elevation.

During the recovery stroke, the power line valve, which is located at an elevation that is lower than the recovery elevation, is closed and a power fluid release valve is opened. The power fluid release valve is at an elevation that is lower than the elevation of the power line valve. The power fluid release valve is at an elevation lower than the product fluid recovery elevation, and the pressure in the pump outlet line forces the piston down and power fluid drains from the power fluid release valve.

The oscillating pressure can be provided by alternating the power line valve and power fluid release valve. The differences in elevation can be selected depending on the relative densities of the power fluid and the product fluid.

The pumping apparatus of the present embodiments is useful in applications where the fluid being pumped contains significant impurities, which can cause damage to conventional pumps, such as a centrifugal pump. For example, sand grains and particles can cause substantial and catastrophic failure to centrifugal pumps. In contrast, similarly sized particles do not cause substantial damage to the pumps of preferred embodiments. Provided the valves are appropriately chosen, even product fluid which contains suspended rocks and other solid materials can be pumped using the pumps of preferred embodiments. Accordingly, the maintenance costs and costs associated with pump failure are greatly reduced. In addition, such a design enables filtration to occur after the product fluid is removed from its source, rather than requiring the pump inlet to contain a filter.

Nevertheless, in some embodiments, the pumping apparatus can be fitted with a filter or screen to reduce the risk of plugging within the pump, which can be flushed or cleaned. The pump can comprise a pump inlet filter, e.g., the filter is a fluid inlet screen placed in the pump housing. Alternatively, the filter or screen can be set off from the exterior surface of the pump housing such that any build up on the filter does not block the pump inlet. However, in some circumstances where the accumulation of particles is less of a concern, the filter can be placed adjacent to or within the pump inlet, as illustrated. The filtering of fluid to the inlet of a pump is well-known in the art, and any suitable filtering or screening mechanism can be utilized. In preferred embodiments, screens that prevent sand particles from entering the pump and also prevent screen clogging are utilized. For example, in some embodiments, well screens with a v-shaped opening, such as Johnson Vee-Wire® screens, can be utilized. Preferred screens have an opening (sometimes referred to as the "slot size") of between about 0.01 inches to about 0.25 inches. These screens prevent the majority of fine sand particles from entering the pump. The openings in the screen are preferably smaller than the smallest channel within the pump. Therefore, any particles that pass through the screen do not plug the pump.

The size of particles permitted to flow through the pump is determined by the size of the perforations or holes in the filter or screen. Preferably, the diameters of the perforations/holes in the filter are at least as small as the smallest channel through which the product fluid passes. Typically, the smallest channel is one of the vent holes. Therefore, any particle small enough to pass through the perforations/holes in the external filter is expected to pass through the pump apparatus without difficulty.

In some embodiments, one way valves are used to prevent the flow of fluid from the reverse direction. However allowing flow in the reverse direction is desirable in many circumstances, such as when the pump or inlet screen has become plugged or is no longer operating optimally. For example, sensors may detect an increased pressure drop across the inlet screen, or across one of the valves in the pump. Alternatively, the pump can be flushed at regular intervals to prevent the accumulation of particles, such as after it has been in operation for a predetermined period or after it has pumped a predetermined amount of fluid.

In some embodiments, the pump is provided with a mechanism by which the one-way valve is prevented from closing. In one embodiment, the one-way valves are prevented from closing only upon an increase in the power fluid pressure beyond the normal operating pressures. In such an embodiment, the increased pressure lifts the piston higher than it is typically lifted during normal operating conditions. Any mechanism which utilizes the increased lift to prevent the valves from closing can be utilized.

The piston can contain an inlet valve stop. During regular operation of the pump, this inlet valve stop does not alter the operation of the pump. When it is necessary to prop open the inlet valve and allow reverse flow, such as for flushing, cleaning, or adding chemicals for cleaning or rehabilitating a hydraulic structure, the power fluid pressure is increased beyond the pressure utilized for normal operation of the pump, thereby lifting the piston higher than usual. When raised to this higher level, the inlet valve stop catches a conical check valve member, thereby preventing it from closing. Thus, fluid is permitted to flow. The stop need not be coupled to the piston.

A piston valve stop can be coupled to the upper surface of the piston, which does not influence the operation of the pump during normal operating conditions. However, when the power fluid pressure is increased beyond its normal operating parameters and the transfer piston rises higher than usual, the transfer piston valve stop is activated and it prevents the transfer piston valve from closing. The transfer piston valve stop can comprise a v-shaped member, a portion of which is positioned under the transfer piston valve member. During normal operation, this v-shaped member does not prevent the transfer piston valve member from lowering and sealing the transfer piston channel. However, when the piston rises to a predetermined level, an activator applies force to the v-shaped member, thereby forcing the valve open. The activator can take the form of a spring as illustrated, a rod extending down from the top cap, or it can be a stop mounted on the inside of the pump housing. Numerous other mechanisms for activating the piston valve stop as known in the art are also suitable for use. In one embodiment, the activator is a spring, as this prevents damage to the pump components (such as the top cap and piston) if the pressure of the power fluid is accidentally increased during normal operation.

If the pump becomes plugged or it is desirable to clean the pump or work on the well, the pump operator can supply power fluid at an increased pressure. The increased pressure in the power fluid source lowers the piston beyond its lowest point during normal operation. If the power fluid is supplied at 1000 psi during normal operation to lower the transfer piston, the power fluid might be supplied at 1200 psi for the stop to contact the activator. The intake check valve stop prevents the valve from closing. Similarly, the transfer check valve stop prevents the valve from closing. The well fluid is then permitted to flow. This allows the pump operators to work on the pump and the well without having to remove the pump from a borehole such as a water, oil, gas or coal bed methane dewatering well.

In some embodiments described herein, the valves are self-actuating one-way valves. However, the valves can optionally be electronically controlled. Using standard computer process control techniques, such as those known in the art, the opening and closing of each valve can be automated. In such embodiments, two-way valves can be utilized. Two-way valves allow the pump operators to open the valves and permit flow in the reverse direction when necessary, such as to flush an inlet or channel that has become plugged or to clean the pump, without employing the valve stop previously discussed. Accordingly, a pump with electronically controlled valves can be flushed or cleaned without increasing the power fluid pressure.

A coaxial disconnect configured to allow removal of any coaxial hydraulic equipment from a coaxial pipe or tube connection without losing either of the two fluids can be employed. In pumps and downhole well applications, the coaxial disconnect is connected between the coaxial tubing installed down the well casing and the coaxial pump located at the bottom of the well. To replace the pump, the coaxial tubing is rolled up onto a waiting tube reel, and the pump is disconnected from the coaxial disconnect. The coaxial disconnect allows the pump to be removed without losing the two fluids located within the coaxial tubing.

A hydraulic subterranean switch (HSS) is configured to reduce the effects of hydraulic fluid compression acting on the pumps at well depths. In downhole well applications, the HSS is connected between coaxial tubing, which is installed down the well casing, and the coaxial pump, located at the bottom of the well. One of these tubes is pressurized to the required hydraulic pressure necessary to drive a piston on its power stroke (as described above). The other hydraulic tube is pressurized to the required hydraulic pressure necessary to drive the piston on its recovery stroke (as described above).

Methods and devices suitable for use in conjunction with aspects of the preferred embodiments are disclosed in U.S. Pat. Nos. 6,193,476; 7,967,578; U.S. Patent Publication No. 2008-0219869-$A_1$; U.S. Patent Publication No. 2005-0169776-$A_1$; U.S. Patent Publication No. 2011-0255997-$A_1$; and U.S. Patent Publication No. 2014-0322035-$A_1$, each of which is hereby incorporated by reference in its entirety.

The above description presents the best mode contemplated for carrying out the present invention, and of the manner and process of making and using it, in such full, clear, concise, and exact terms as to enable any person skilled in the art to which it pertains to make and use this invention. This invention is, however, susceptible to modifications and alternate constructions from that discussed above that are fully equivalent. Consequently, this invention is not limited to the particular embodiments disclosed. On the contrary, this invention covers all modifications and alternate constructions coming within the spirit and scope of the invention as generally expressed by the following claims, which particularly point out and distinctly claim the subject matter of the invention. While the disclosure has been illustrated and described in detail in the drawings and foregoing description, such illustration and description are to be considered illustrative or exemplary and not restrictive.

All references cited herein are incorporated herein by reference in their entireties. To the extent publications and patents or patent applications incorporated by reference contradict the disclosure contained in the specification, the specification is intended to supersede and/or take precedence over any such contradictory material.

Unless otherwise defined, all terms (including technical and scientific terms) are to be given their ordinary and customary meaning to a person of ordinary skill in the art, and are not to be limited to a special or customized meaning unless expressly so defined herein. It should be noted that the use of particular terminology when describing certain features or aspects of the disclosure should not be taken to imply that the terminology is being re-defined herein to be restricted to include any specific characteristics of the features or aspects of the disclosure with which that terminology is associated. Terms and phrases used in this application, and variations thereof, especially in the appended claims, unless otherwise expressly stated, should be construed as open ended as opposed to limiting. As examples of the foregoing, the term 'including' should be read to mean 'including, without limitation,' 'including but not limited to,' or the like; the term 'comprising' as used herein is synonymous with 'including,' 'containing,' or 'characterized by,' and is inclusive or open-ended and does not exclude additional, unrecited elements or method steps; the term 'having' should be interpreted as 'having at least;' the term 'includes' should be interpreted as 'includes but is not limited to;' the term 'example' is used to provide exemplary instances of the item in discussion, not an exhaustive or limiting list thereof; adjectives such as 'known', 'normal', 'standard', and terms of similar meaning should not be construed as limiting the item described to a given time period or to an item available as of a given time, but instead should be read to encompass known, normal, or standard technologies that may be available or known now or at any time in the future; and use of terms like 'preferably,' 'preferred,' 'desired,' or 'desirable,' and words of similar meaning should not be understood as implying that certain features are critical, essential, or even important to the structure or function of the invention, but instead as merely intended to highlight alternative or additional features that may or may not be utilized in a particular embodiment of the invention. Likewise, a group of items linked with the conjunction 'and' should not be read as requiring that each and every one of those items be present in the grouping, but rather should be read as 'and/or' unless expressly stated otherwise. Similarly, a group of items linked with the conjunction 'or' should not be read as requiring mutual exclusivity among that group, but rather should be read as 'and/or' unless expressly stated otherwise.

Where a range of values is provided, it is understood that the upper and lower limit, and each intervening value between the upper and lower limit of the range is encompassed within the embodiments.

With respect to the use of substantially any plural and/or singular terms herein, those having skill in the art can translate from the plural to the singular and/or from the singular to the plural as is appropriate to the context and/or application. The various singular/plural permutations may be expressly set forth herein for sake of clarity. The indefinite article 'a' or 'an' does not exclude a plurality. A single processor or other unit may fulfill the functions of several items recited in the claims. The mere fact that certain measures are recited in mutually different dependent claims does not indicate that a combination of these measures cannot be used to advantage. Any reference signs in the claims should not be construed as limiting the scope.

It will be further understood by those within the art that if a specific number of an introduced claim recitation is intended, such an intent will be explicitly recited in the claim, and in the absence of such recitation no such intent is present. For example, as an aid to understanding, the following appended claims may contain usage of the introductory phrases 'at least one' and 'one or more' to introduce claim recitations. However, the use of such phrases should not be construed to imply that the introduction of a claim recitation by the indefinite articles 'a' or 'an' limits any particular claim containing such introduced claim recitation to embodiments containing only one such recitation, even when the same claim includes the introductory phrases 'one or more' or 'at least one' and indefinite articles such as 'a' or 'an' (e.g., 'a' and/or 'an' should typically be interpreted to mean 'at least one' or 'one or more'); the same holds true for the use of definite articles used to introduce claim recitations. In addition, even if a specific number of an introduced claim recitation is explicitly recited, those skilled in the art will recognize that such recitation should typically be interpreted to mean at least the recited number (e.g., the bare recitation of 'two recitations,' without other modifiers, typically means at least two recitations, or two or more recitations). Furthermore, in those instances where a convention analogous to 'at least one of A, B, and C, etc.' is used, in general such a construction is intended in the sense one having skill in the art would understand the convention (e.g., 'a system having at least one of A, B, and C' would include but not be limited to systems that have A alone, B alone, C alone, A and B together, A and C together, B and C together, and/or A, B, and C together, etc.). In those instances where a convention analogous to 'at least one of A, B, or C, etc.' is used, in general such a construction is intended in the sense one having skill in the art would understand the convention (e.g., 'a system having at least one of A, B, or C' would include but not be limited to systems that have A alone, B alone, C alone, A and B together, A and C together, B and C together, and/or A, B, and C together, etc.). It will be further understood by those within the art that virtually any disjunctive word and/or phrase presenting two or more alternative terms, whether in the description, claims, or drawings, should be understood to contemplate the possibilities of including one of the terms, either of the terms, or both terms. For example, the phrase 'A or B' will be understood to include the possibilities of 'A' or 'B' or 'A and B.'

All numbers expressing quantities of ingredients, reaction conditions, and so forth used in the specification are to be understood as being modified in all instances by the term 'about.' Accordingly, unless indicated to the contrary, the numerical parameters set forth herein are approximations that may vary depending upon the desired properties sought to be obtained. At the very least, and not as an attempt to limit the application of the doctrine of equivalents to the scope of any claims in any application claiming priority to the present application, each numerical parameter should be construed in light of the number of significant digits and ordinary rounding approaches.

Furthermore, although the foregoing has been described in some detail by way of illustrations and examples for purposes of clarity and understanding, it is apparent to those skilled in the art that certain changes and modifications may be practiced. Therefore, the description and examples should not be construed as limiting the scope of the invention to the specific embodiments and examples described herein, but rather to also cover all modification and alternatives coming with the true scope and spirit of the invention.

What is claimed is:

1. A pumping apparatus for a well, comprising:

a power fluid passage in fluid communication with a power fluid line;

a product fluid passage in fluid communication with a product fluid line;

a piston reciprocatingly mounted within the pumping apparatus, the piston defining a product fluid chamber in fluid communication with the product fluid passage and comprising a first check valve;

a bottom block positioned at a bottom portion of the pumping apparatus, the bottom block comprising a well fluid inlet having a second check valve;

a well fluid intake chamber positioned between the bottom block and the piston and configured to receive well fluid through the second check valve when the second check valve is open;

one or more piston vent chambers, each of the one or more piston vent chambers in fluid communication with the product fluid chamber via one or more piston vent chamber vents, the one or more piston vent chambers comprising a first piston vent chamber and a second piston vent chamber positioned between the first piston vent chamber and the well fluid intake chamber; and one or more well vent chambers, each well vent chamber in fluid communication with well fluid external to the pumping apparatus via one or more well vent chamber vents, wherein each well vent chamber is defined at least partially by the piston, wherein the one or more well vent chambers comprise a first well vent chamber positioned between the first piston vent chamber and the second piston vent chamber and a second well vent chamber positioned between the second piston vent chamber and the well fluid intake chamber;

wherein the product fluid chamber is configured to receive the well fluid from the well fluid intake chamber through the first check valve when the first check valve is open.

2. The pumping apparatus of claim 1, further comprising a power fluid chamber positioned between the power fluid passage and the piston, the power fluid chamber configured to receive pressurized power fluid through the power fluid passage, wherein the piston is configured such that the power fluid within the power fluid chamber acts against an area of the piston in a direction of downward movement of the piston.

3. The pumping apparatus of claim 1, wherein the piston is configured such that product fluid within each of the one or more piston vent chambers is configured to act against an area of the piston in a direction of upward movement of the piston.

4. The pumping apparatus of claim 3, wherein the piston is configured to move in an upward direction when a sum of forces generated by the product fluid in each of the one or more piston vent chambers acting against the piston in the direction of upward movement of the piston is greater than a sum of a force generated by power fluid acting against the piston in a direction of downward movement of the piston and a force generated by the product fluid in the product fluid chamber acting against the piston in the direction of downward movement of the piston.

5. The pumping apparatus of claim 1, wherein one or both of the first check valve and the second check valve comprise a ball check valve.

6. The pumping apparatus of claim 1, wherein the first check valve is configured to open in response to a downward movement of the piston within the pumping apparatus.

7. The pumping apparatus of claim 1, wherein the second check valve is configured to open in response to an upwards movement of the piston within the pumping apparatus.

8. A method for pumping fluid, comprising:

introducing the power fluid into the power fluid chamber of the pumping apparatus of claim 2, whereby the piston is lowered so as to open the first check valve, whereby well fluid to be pumped is drawn through the first check valve and product fluid is displaced through the product fluid passage.

9. The method of claim 8, further comprising facilitating a flow of the product fluid through the product fluid passage and into the product fluid chamber, whereby the piston rises, the first check valve closes, and the second check valve opens, whereby the well fluid to be pumped is drawn into the well fluid intake chamber.

10. The method of claim 9, wherein facilitating the flow of the product fluid through the product fluid passage and into the product fluid chamber comprises decreasing a pressure of the power fluid in the power fluid chamber.

* * * * *